US011832041B2

(12) United States Patent
Kwon et al.

(10) Patent No.: US 11,832,041 B2
(45) Date of Patent: Nov. 28, 2023

(54) REFRIGERATOR CAPABLE OF SOUND INPUT

(71) Applicant: LG ELECTRONICS INC., Seoul (KR)

(72) Inventors: O Min Kwon, Seoul (KR); Hyungkyu Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 89 days.

(21) Appl. No.: 17/359,005

(22) Filed: Jun. 25, 2021

(65) Prior Publication Data

US 2021/0321183 A1 Oct. 14, 2021

Related U.S. Application Data

(63) Continuation of application No. 16/553,430, filed on Aug. 28, 2019, now Pat. No. 11,076,212.

(30) Foreign Application Priority Data

Jan. 31, 2019 (KR) ..... 10-2019-0012867

(51) Int. Cl.

| | |
|---|---|
| ***H04R 1/04*** | (2006.01) |
| ***H04R 1/02*** | (2006.01) |
| ***F25D 23/02*** | (2006.01) |
| ***F25D 29/00*** | (2006.01) |
| ***H04R 3/00*** | (2006.01) |
| *F25D 23/04* | (2006.01) |

(52) U.S. Cl.

CPC ..... *H04R 1/028* (2013.01); *F25D 23/028* (2013.01); *F25D 29/005* (2013.01); *H04R 1/025* (2013.01); *H04R 1/04* (2013.01); *H04R 3/00* (2013.01); *F25D 23/04* (2013.01); *F25D 2323/021* (2013.01); *F25D 2323/023* (2013.01)

(58) Field of Classification Search

None

See application file for complete search history.

(56) References Cited

U.S. PATENT DOCUMENTS

| | | | |
|---|---|---|---|
| 5,856,781 | A | 1/1999 | Michel et al. |
| 6,005,641 | A | 12/1999 | Ui |
| 2001/0010516 | A1 | 8/2001 | Roh et al. |
| 2004/0194253 | A1 | 10/2004 | Jung |

(Continued)

FOREIGN PATENT DOCUMENTS

| | | |
|---|---|---|
| CN | 2583583 | 10/2003 |
| CN | 202709615 | 1/2013 |

(Continued)

OTHER PUBLICATIONS

European Search Report dated Feb. 25, 2020 issued in EP Application No. 19194404.0.

(Continued)

*Primary Examiner* — Quynh H Nguyen

(74) *Attorney, Agent, or Firm* — KED & ASSOCIATES, LLP

(57) ABSTRACT

A door cover defines an upper surface of a door of a refrigerator. The door cover includes a microphone pocket in which a microphone mount is provided and a separate speaker pocket in which a speaker mount is provided.

30 Claims, 27 Drawing Sheets

(56) References Cited

U.S. PATENT DOCUMENTS

| | | | | |
|---|---|---|---|---|
| 2010/0326112 | A1* | 12/2010 | Prabhakar | F25D 23/028 62/449 |
| 2012/0285089 | A1 | 11/2012 | Artwohl et al. | |
| 2016/0202786 | A1 | 7/2016 | Lee et al. | |
| 2016/0209569 | A1* | 7/2016 | Cho | G02B 6/0076 |
| 2017/0133002 | A1 | 5/2017 | Jung | |
| 2017/0370636 | A1 | 12/2017 | Koo et al. | |
| 2018/0292127 | A1* | 10/2018 | Park | F25D 27/005 |
| 2019/0127216 | A1 | 5/2019 | Tagaya | |
| 2019/0279625 | A1 | 9/2019 | Huang | |

FOREIGN PATENT DOCUMENTS

| | | | | |
|---|---|---|---|---|
| CN | 203722799 | | 7/2014 | |
| CN | 205403317 | * | 7/2016 | |
| CN | 106196865 | | 12/2016 | |
| CN | 106322899 | | 1/2017 | |
| CN | 206817844 | | 12/2017 | |
| CN | 2067397332 | | 12/2017 | |
| CN | 107664385 | | 2/2018 | |
| CN | 107690113 | | 2/2018 | |
| CN | 109028737 | | 12/2018 | |
| ES | 2344723 | | 9/2010 | |
| JP | 2001082870 A | * | 3/2001 | |
| JP | 2006311076 | | 11/2006 | |
| JP | 2019-132568 | | 8/2019 | |
| KR | 10-1999-00418 32 | | 6/1999 | |
| KR | 10-2005-0070959 | | 7/2005 | |
| KR | 10-0650280 | | 11/2006 | |
| KR | 10-2007-0106118 | | 11/2007 | |
| KR | 10-2017-0024363 | | 3/2017 | |
| KR | 10-2017-0110486 | | 10/2017 | |
| KR | 10-2018-0013188 | | 2/2018 | |
| KR | 10-2018-0079835 | | 7/2018 | |
| WO | WO 2014/208585 | | 12/2014 | |
| WO | WO-2017034332 A1 | * | 3/2017 | F21V 23/0471 |
| WO | WO 2018/006570 | | 1/2018 | |

OTHER PUBLICATIONS

United States Office Action dated Mar. 13, 2020 issued in U.S. Appl. No. 16/553,430.

Australian Examination Report dated Jun. 19, 2020 issued in Application No. 2019222944.

United States Office Action dated Jul. 6, 2020 issued in U.S. Appl. No. 16/553,430.

United States Office Action dated Sep. 22, 2020 issued in U.S. Appl. No. 16/553,430.

United States Office Action dated Jan. 21, 2021 issued in U.S. Appl. No. 16/553,430.

United States Notice of Allowance dated Mar. 30, 2021 issued in U.S. Appl. No. 16/553,430.

Chinese Office Action issued in 201910277545.X dated May 28, 2021.

Chinese Office Action dated Apr. 20, 2023 issued in Application No. 202210050179.6.

Korean Office Action dated Jul. 24, 2023 issued in Application No. 10-2019-0012867.

* cited by examiner

REFRIGERATOR CAPABLE OF SOUND INPUT

CROSS-REFERENCE TO RELATED APPLICATIONS

This application is a Continuation of U.S. application Ser. No. 16/553,430, filed on Aug. 28, 2019, which claims priority to and the benefit of Korean Patent Application No. 10-2019-0012867, filed in Korea on Jan. 31, 2019, the entire disclosures of which are incorporated herein by reference.

BACKGROUND

1. Field

A refrigerator capable of sound input is disclosed herein.

2. Background

Generally, a refrigerator is a home appliance that may store food in an inner storage space that is blocked by a door, at a low temperature. To this end, the refrigerator may cool the inside of the storage space in the refrigerator using cool air generated through heat exchange with a refrigerant circulating in a refrigeration cycle, thereby storing the food in an optimum state.

Recently, refrigerators have become larger in size and more multifunctional due to a tendency of changes in dietary life and high quality of products. Refrigerators that have various types of convenience apparatuses are released to improve convenience of users.

In particular, recently, various types of refrigerators have been developed to allow the user to control an operation of the refrigerator using a voice input from the user. In the refrigerator, there may be a problem that the door may not be freely opened and closed or the refrigerator may not be operated freely when the user holds an object with both hands. To solve this problem, a refrigerator has been developed in which a microphone is arranged in the refrigerator and the operation of the refrigerator is controlled by receiving a voice input from the user.

Patent Document 1 discloses a structure in which a microphone to which speech of a user is inputted, and the speech received at the microphone is analyzed by a speech signal recognizer to operate a motor that drives the door. With such a structure, the user may input the speech to the microphone to open and close the door.

Patent Document 2 discloses a refrigerator in which a microphone is provided in a cabinet or a door, and output of a screen provided on the door is controlled by the microphone. Such a structure enables the user to adjust the screen of the refrigerator and control the operation of the refrigerator through speech of the user. However, there is no specific description of a position at which the microphone is arranged and an arrangement structure of the microphone, in the related art.

A speech recognition rate may be highest when the microphone is arranged on the main body of the refrigerator or the front surface of the door of the refrigerator in order to increase a speech recognition rate. However, when a microphone hole is formed at a position corresponding to the position at which the microphone is arranged and is exposed to the outside, an appearance of the refrigerator may be deteriorated. Further, even if the microphone is arranged on the front surface of the door, the speech recognition rate might be lowered due to the noise generated by the dispenser, and the like.

When the microphone hole is arranged at a position invisible to the user, the speech recognition rate may be lowered, or a large amount of noise may be generated because of the structure thereof. For example, a compressor that causes vibration and noise generated by the operation of the refrigerator may be installed at a rear lower portion of the refrigerator. If the microphone hole is arranged close to the compressor, the speech recognition rate may be lowered. Further, dust or dirt may block the microphone hole depending on the position of the microphone, and in this case, normal speech input of the user may be impossible.

Meanwhile, there is no detailed description of an installation structure of a speaker that may provide the user with feedback about speech recognition through speech in the related art document. Unlike the microphone, to provide the volume of the speaker, an exposed area of the speech output may be provided. Providing the exposed area of the speech output may create a high probability that the dust or a foreign substance will pass through the exposed area of the speech output.

Further, the parts that perform the input as the speech recognition and the output as the speech feedback may be arranged close to each other for convenience of design, manufacturing, and maintenance of the parts. However, the output as the speech feedback may be inputted back to the input as the speech recognition.

Patent Document KR Patent Laid-Open Publication No. 10-1999-0041832; KR Patent Laid-Open Publication No. 10-2018-0079835.

BRIEF DESCRIPTION OF THE DRAWINGS

Embodiments will be described in detail with reference to the following drawings in which like reference numerals refer to like elements, and wherein.

DETAILED DESCRIPTION

Figure 1:
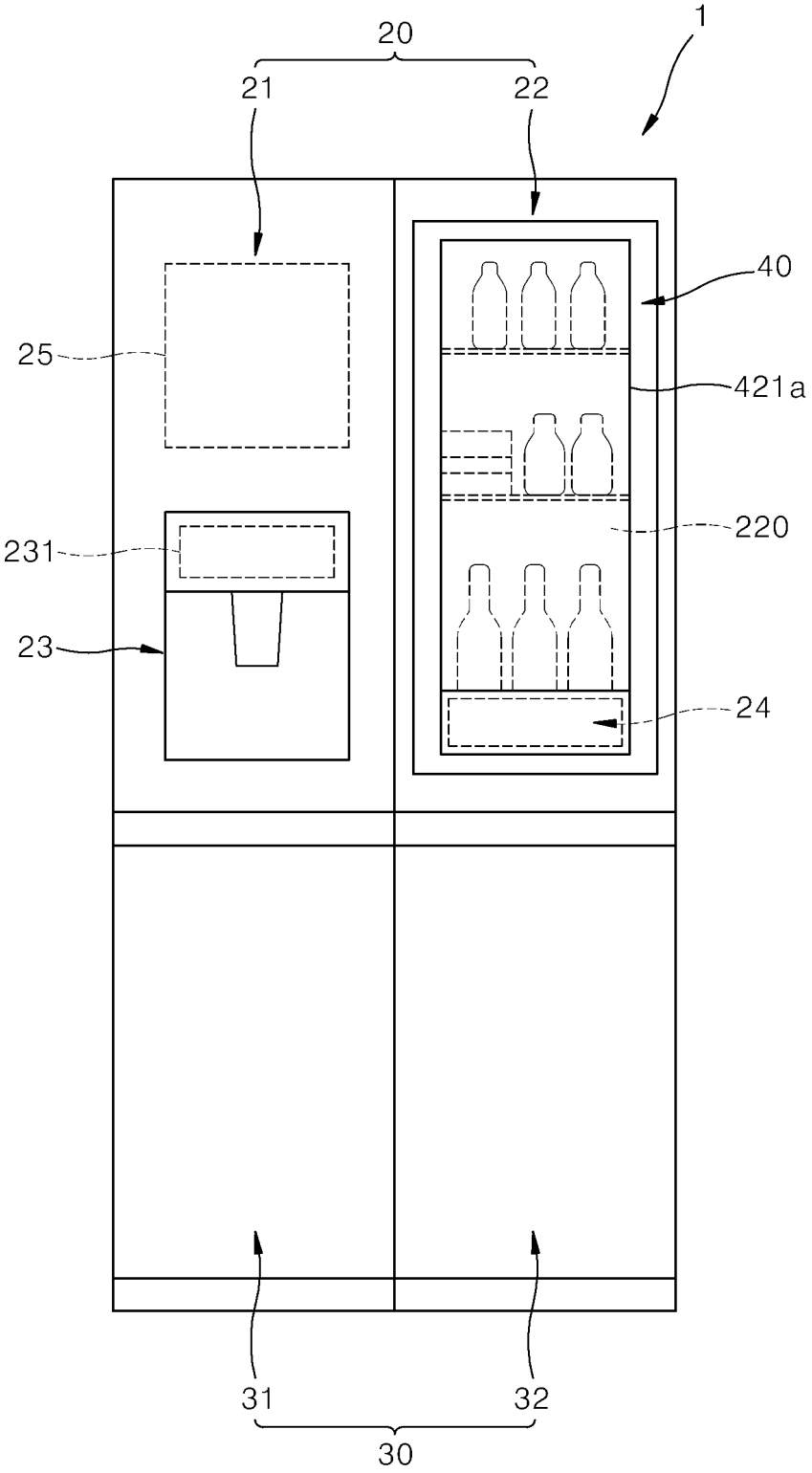
FIG. 1 is a front view of a refrigerator according to an implementation of the present disclosure.
Figure 2:
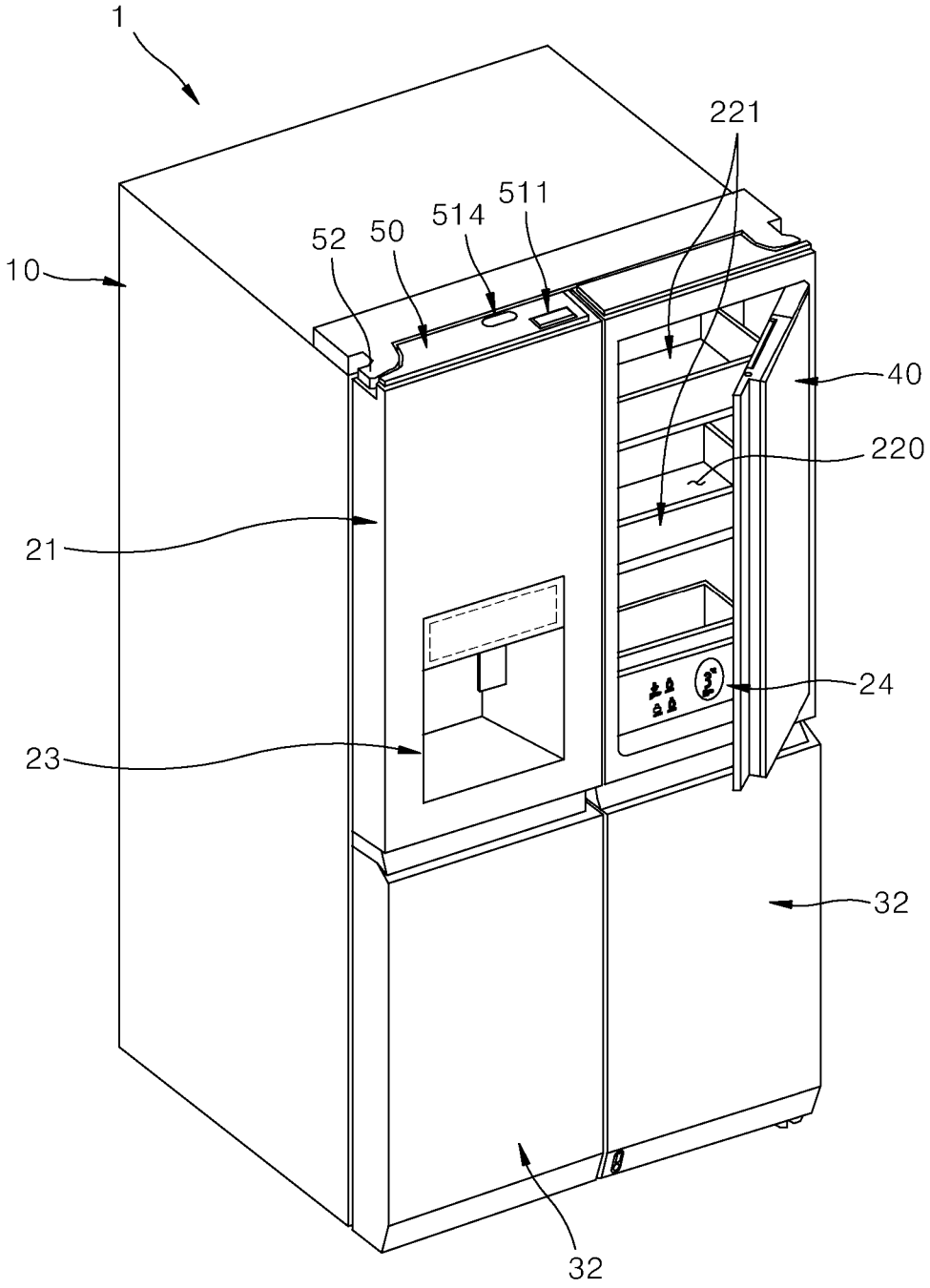
FIG. 2 is a perspective view of the refrigerator.
Figure 3:
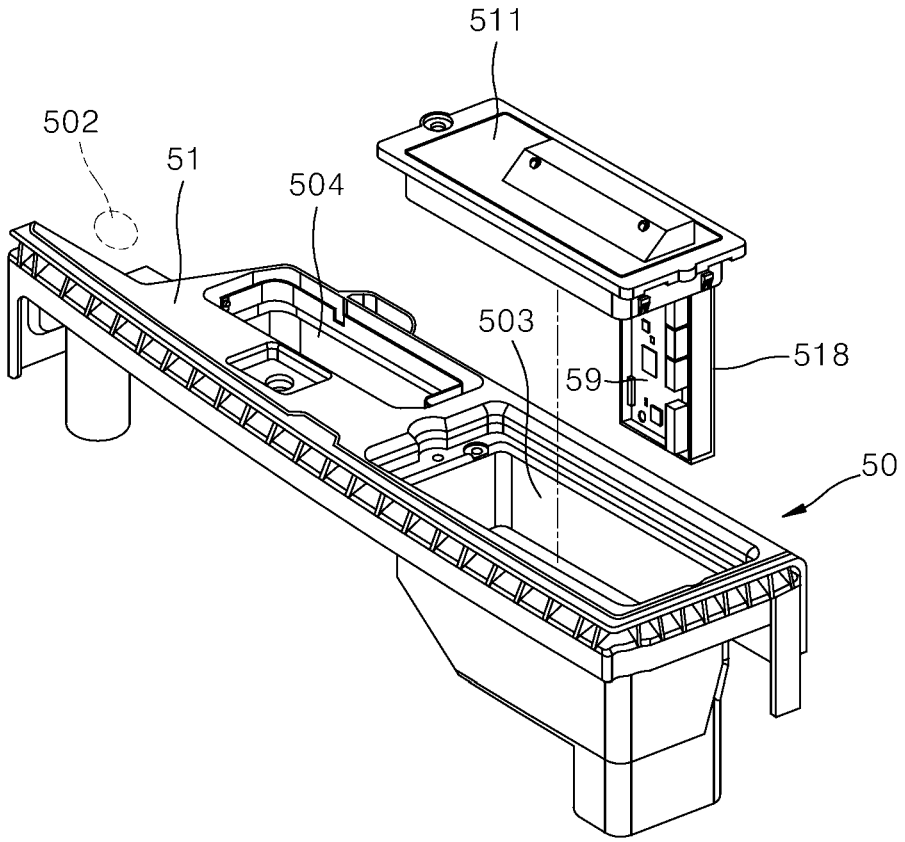
FIG. 3 is a perspective view of a cap deco of a refrigerator door and a microphone mount installed thereon according to an implementation.

According to the implementation of the present disclosure, an outer shape of a refrigerator 1 may be formed by a cabinet 10 that forms a storage space and doors 20 and 30 that open and close the storage space. An inside of the cabinet 10 may be divided into upper and lower portions thereof. A refrigerating compartment may be formed at the upper portion of the cabinet 10, and a freezer compartment may be formed at the lower portion of the cabinet 10. The inside of the cabinet 10 may be divided into left and right sides thereof, and a refrigerating compartment and a freezer compartment may be formed at both a left side and a right side of the cabinet 10, respectively.

The door may include a refrigerating compartment door 20 and a freezer compartment door 30. The refrigerating compartment door 20 and the freezer compartment door 30 may be rotatably installed to open and close the refrigerating compartment and the freezer compartment, respectively.

The refrigerating compartment door 20 may include a pair of doors 21 and 22 that open and close a refrigerating compartment at an upper portion of the cabinet 10, in other words, a left refrigerating compartment door 21 and a right refrigerating compartment door 22. The freezer compartment door 30 may include a pair of doors 31 and 32 that open and close the lower portion of the cabinet 10, in other words, a left freezer compartment door 31 and a right freezer compartment door 32.

The implementations of the present disclosure may be applied to any types of doors of a refrigerator regardless of a form and a structure of the door. For convenience of explanation and understanding, a refrigerator that has a refrigerating compartment door and a freezer compartment door will be described.

An ice maker 25 may be provided at the inner side of the left refrigerating compartment door 21. The ice maker 25 may make ice by automatic water supply and may store ice in the ice maker, and may be provided in a heat insulating space formed on a rear surface of the left refrigerating compartment door 21.

A dispenser 23 may be provided on a front surface of the left refrigerating compartment door 21. The dispenser 23 may allow the ice produced by the ice maker 25 or purified water to be taken out through the dispenser 23, so that water or the ice may be taken out through the dispenser 23 by an external operation of the user.

A second display 231 may be provided on the dispenser 23. The second display 231 may display an operation state of the dispenser 23 and the refrigerator 1 and input the operation of the dispenser 23 and the refrigerator 1. When the first display 24 is not provided on the right refrigerating compartment door 22, the second display 231 may perform the function of the first display 24 instead.

The right refrigerating compartment door 22 may have an opening 220 at a center thereof and a door basket 221 may be provided in the opening 220. A sub-door 40 that opens and closes the opening 220 may be provided. Accordingly, the user may access the door basket 221 by opening and closing the sub-door 40.

One end of the sub-door 40 may be rotatably coupled to the right refrigerating compartment door 22 by a hinge method and a handle gripped by the user may be depressed at the other end of the sub-door 40 to facilitate a rotation operation of the sub-door 40. At least a part 421*a* of the sub-door 40 may be selectively transparent or opaque so that the inside of the opening 220 may be visible even when the sub-door 40 is closed.

The first display 24 may be provided at a lower portion of the opening 220. The first display 24 may display an operation state of the refrigerator and allow the user to operate and input the operation of the refrigerator 1.

Accordingly, when the first display 24 is turned on even when the sub-door 40 is closed, the user may identify output information of the first display 24 through the sub-door 40. Of course, the first display 24 may be omitted or removed from a refrigerator without the sub-door 40, and a function of the first display 24 may be replaced by the second display 231.

The doors 21 and 22 may include an out-plate that defines an appearance of the front surface and a circumferential surface of the doors 21 and 22 and a door liner that is coupled to the out-plate and forms a rear surface of the doors 21 and 22. The out-plate may be made of a metal. An opening may be formed at the center of the out-plate of the right refrigerating compartment door 22 to install the sub-door 40. The door liner may form a rear surface of the doors 21 and 22. The out-plate and the door liner may alternatively be referred to as front and rear panels.

Figure 27:
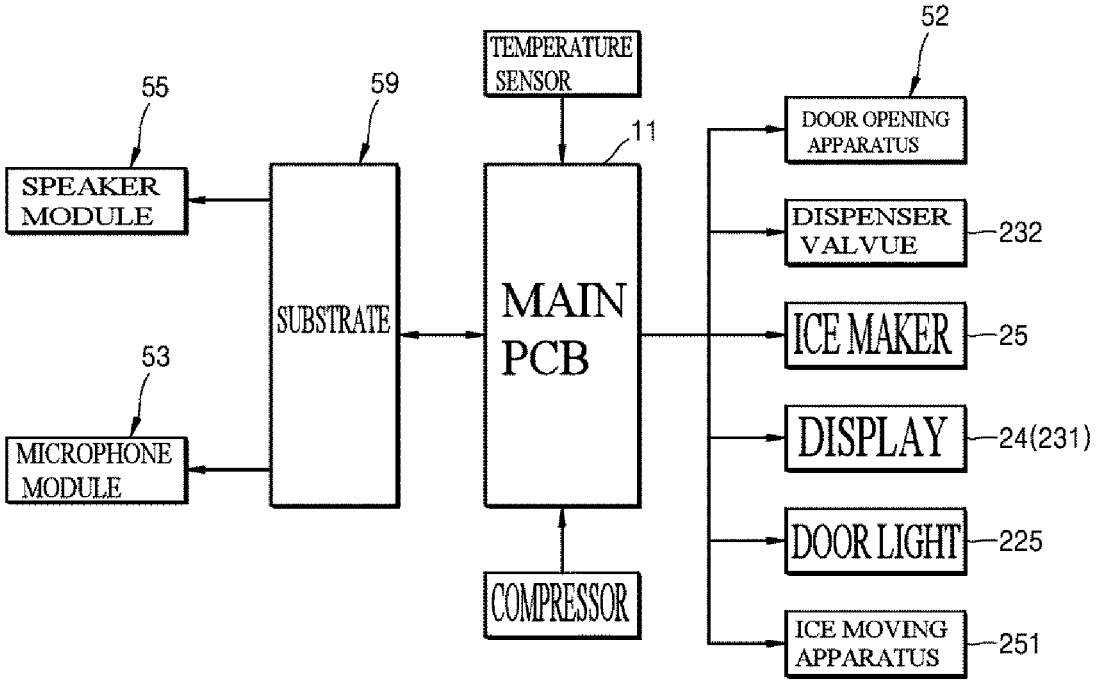
FIG. 27 is a block diagram of a flow of a control signal of the refrigerator.

A door light 225 (see FIG. 27) may be mounted on the door liner of the right refrigerating compartment door 22. The door light may illuminate the inside of the opening 220. When the door light is turned on, the inside of the opening 220 may be illuminated, and even when the sub-door 40 is closed, the food stored in the door basket 221 may be viewed through a perspective part 421*a* of the sub-door 40. When the door light is turned off, the inside of the opening 220 may be darkened and the inside of the opening 20 may not be visible through the perspective part 421*a* of the sub-door 40. The perspective part 421*a* of the sub-door 40 may be perceived as opaque or a mirror surface. A gasket may be mounted on the door liner, and the gasket may be formed along a circumference of the door.

A cap deco 50 may be provided at upper portions of the refrigerating compartment doors 21 and 22. The cap deco 50 may define an appearance of an upper surface of the refrigerating compartment doors 21 and 22. The appearance of the upper surface may be defined by an upper cover 51 included in the upper surface of the cap deco 50. The cap deco 50 may be coupled to the door liner and the out-plate to form the upper surfaces of the refrigerating compartment doors 21 and 22. An inner space of the refrigerating compartment doors 21, 22 formed by the out-plate, the door liner, and the cap deco 50 may be filled with a heat insulating material. The cap deco 50 may be made of a plastic material, and a hinge to rotate the door 22 may be mounted at one side edge of the cap deco 50.

A door opening apparatus 52 may be installed close to the hinge mount of the cap deco 50 as necessary. The door opening apparatus 52 may automatically open the doors 21 and 22 even if the user does not directly pull the doors 21 and 22 when the doors 21 and 22 are closed. When the doors 21 and 22 are pushed closed, the doors 21 and 22 may be closed by themselves due to the weight of the doors 21 and 22.

The door opening apparatus 52 may be controlled through a voice input or speech of the user inputted to the microphone module 53. For example, the door 22 may be opened and closed through the speech of the user.

An upper cover 51 of the cap deco 50 may include a microphone accommodator or pocket 503 and a speaker accommodator or pocket 504 that provide a space that a microphone mount 511 and a speaker mount 514 may be accommodated. The microphone pocket 503 and the speaker pocket 504 may be partitioned into separate spaces from each other, so that sound generated by the speaker module 55 installed in the speaker accommodator 504 may not affect an input of the microphone module 53 installed in the microphone pocket 503.

The microphone mount 511 and the speaker mount 514 may be provided on the cap deco 50 installed at the upper portion of the left refrigerating compartment door 21. A controller 11 may be installed in the left refrigerating compartment door 21 on which the second display 231 is installed. The microphone module 55 and the speaker module 53 may be electrically connected to the controller 11 through a cable, or the like. The cable may be arranged in the inner space of the door and may be embedded within the heat insulating material.

The microphone module 53 and the microphone mount 511 may be provided at a position biased to the right or a right end of the left refrigerating compartment door 21. A pair of refrigerating compartment doors 20 may have a side-by-side arrangement. When the microphone module 53 is arranged at the right end of the left refrigerating compartment door 21, the microphone may recognize the speech of the user more efficiently when the user speaks at the center of the refrigerator 1. In the implementation, the microphone module 53 and the speaker module 55 may be provided in the left refrigerating compartment door 21, but the present disclosure may be applied to any types of refrigerators in which a cap deco is formed on the upper surface of the door.

A microphone mount 511 on which a microphone module 53 that receives a voice input of a user is mounted may be installed in a microphone accommodator 503. The microphone mount 511 may have a flat shape corresponding to a door cover 51 of a cap deco 50 when being mounted on the cap deco 50. The door cover 51 may define an entire upper surface of the door with the microphone mount 511 when the microphone mount 511 is mounted on the cap deco 50. Of course, the door cover 51 may define the entire upper surface of the door, with the speaker mount 514.

An upward protruding shape may be formed at a central portion of the flat surface of the microphone mount 511. The microphone module 53 may be installed in an inner space provided at a lower portion of the member that defines the protruding shape.

The microphone mount 511 may be invisible when viewed from the front due to the properties of the shape thereof. As a height of the refrigerator may be greater than a height of the user, the protruding shape of the microphone mount 511 may not be visible to the user in a normal use environment. Even when the user is away from the refrigerator 1, the microphone mount 511 and a microphone hole 512 provided at the microphone mount 511 may not be visible to the user.

Further, the upper end of the door 21 may be arranged far away from a machine room in which the compressor that causes noise and the vibration is installed, thereby making it possible to minimize the input of other kind of noise than the speech of the user, to the microphone. Further, the microphone provided at the upper end of the door 21 may not be affected by the noise generated when a dispenser 23 installed on the front surface of the door 21 is operated.

In other words, the microphone mount 511 may have a position and a structure that provide a high recognition rate while minimizing external exposure. Hereinafter, the structure of the microphone mount 511 and the microphone module 53 will be described in more detail.

The microphone module 53 may receive the voice input of the user to control the operation of the refrigerator 1 and may be mounted on the microphone mount 511. The microphone module 53 may closely contact under the microphone mount 511 provided on the door cover 51 and may be supported by a microphone supporter 54. A microphone hole 512 may be further formed at the microphone mount 511 and the voice input of the user may be introduced into the microphone module 53 mounted in the microphone mount 511 through the microphone hole 512.

The speaker module 55 may output the sound, and may output information that may be outputted as sound, such as operation state information of the refrigerator 1 or information requested by the user. The speaker module 55 may be fixed to a lower portion of the speaker mount 514 installed on the door cover 51.

The door cover 51 may form the upper surface of the door 22 and the microphone module 53 and the speaker module 55 may be fixed to the door cover 51. The microphone module 53 may be installed in the microphone mount 511 and the microphone mount 511 may be accommodated and installed in the microphone accommodator 503 of the door cover 51. The speaker module 57 may be installed in a speaker mount 514 and the speaker mount 514 may be installed in a speaker accommodator 504 of the door cover 51. In other words, the microphone module 53 and the speaker module 55 may be provided on the door 21 while being suspended from the door cover 51.

Particularly, the microphone module 53 may be attached to a lower surface of the microphone mount 511, thereby minimizing noise introduced into the microphone module 53. For example, noise and vibration of the apparatuses such as a compressor, which is operated according to a refrigeration cycle during operation of the refrigeration cycle, may be continuously generated in the refrigerator 1 due to a property of the operation of the refrigerator 1, thereby preventing the vibration and the noise from being transmitted to the microphone module 53 through a member of the door 21.

Further, the microphone mount 511 may be manufactured as a separate component from the speaker mount 514, thereby minimizing the influence of the vibration generated by the speaker module 55 on the microphone mount 511. Therefore, the microphone module 53 may be mounted in the door 22 so as not to be exposed and may be spaced apart from the inside of the door 21 to minimize the influence of the noise generated during the operation of the refrigerator 1, thereby improving the speech recognition rate.

The microphone mount 511 may be in the same plane as the door cover 51 when being mounted on the door cover 51. The microphone mount 511 may include a protrusion 511*a* protruding upward from a substantially central portion of the microphone mount 511 and an inclination 511*b* formed at a front end of the protrusion 511*a*.

The protrusion 511*a* may protrude furthest from the microphone mount 511. A top of protrusion 511*a* may be parallel with the upper surface of the microphone mount 511 which is in one plane with the door cover 51. A microphone mounting boss 517 may extend downward under the protrusion 511*a*. The microphone mounting boss 517 may have a cylindrical shape with a hole opened downward.

A pair of microphone mounting bosses 517 may be provided on both left and right sides and may be inserted into a supporter through-hole 546 of the microphone supporter 54. A screw S passing through the supporter through-hole 546 may be fastened to the hole of the microphone mounting boss 517 from a lower portion of the hole so that the microphone supporter 54 may be fixed to the lower surface of a protrusion 511*a*. In other words, when the screw S is tightened, a head of the screw S may push the microphone supporter 54 upward.

The microphone hole 512 may be provided at a height such that the microphone hole 512 is not visible to the user and the speech of the user may be easily transmitted. A protruding height of the protrusion 511*a* may be about a height at which the microphone hole 512 is formed in the inclination 511*b* or may be slightly greater than the height thereof. The protrusion 511*a* may have a height at which the microphone mount 511 is not visible when viewed from the front. For example, the protrusion 511*a* may have a height of 2 mm to 5 mm, preferably 2 mm to 3 mm.

Figure 8:
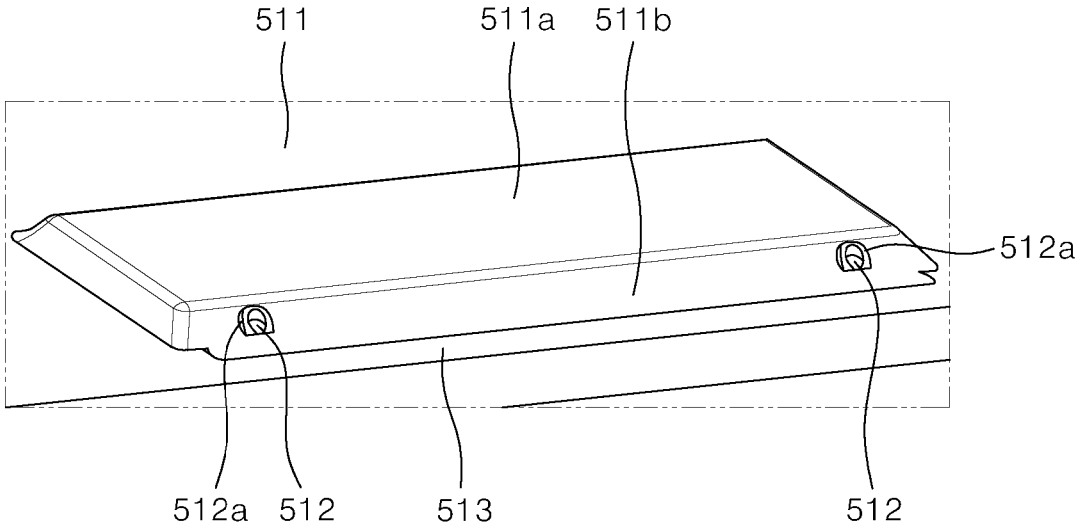
FIG. 8 is a partially enlarged view of a microphone mount according to an implementation of the present disclosure.
Figure 9:
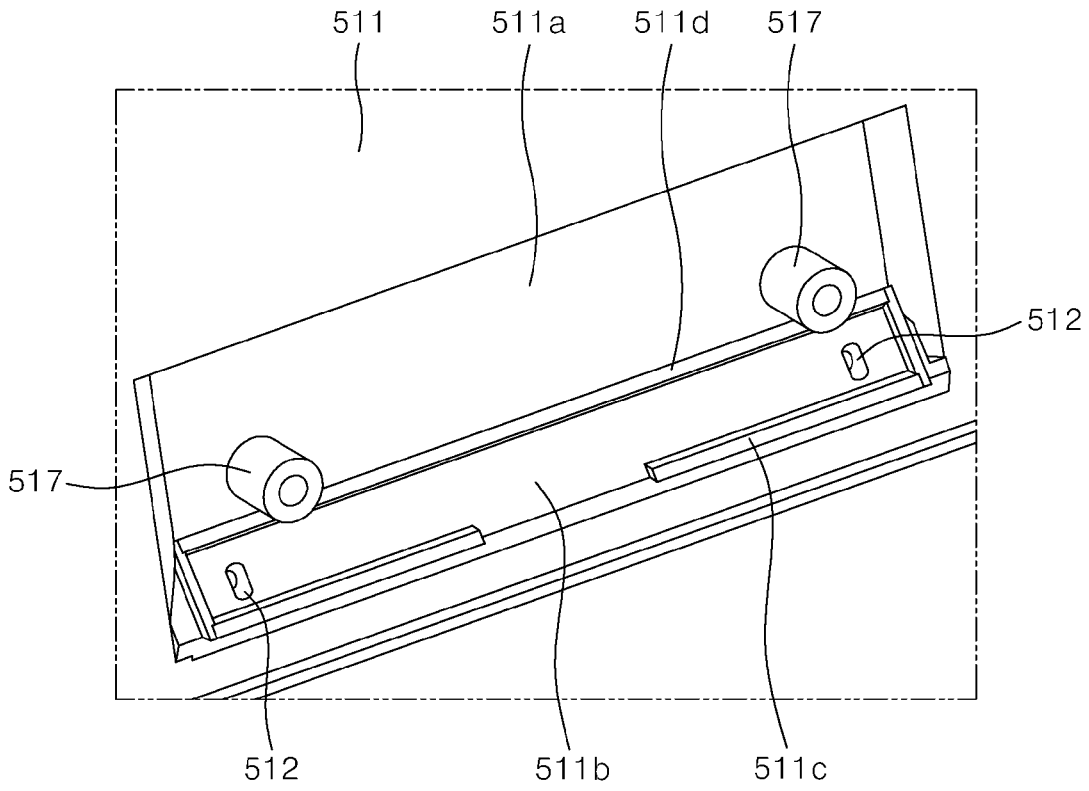
FIG. 9 is a perspective view of the microphone mount as viewed from below.
Figure 10:
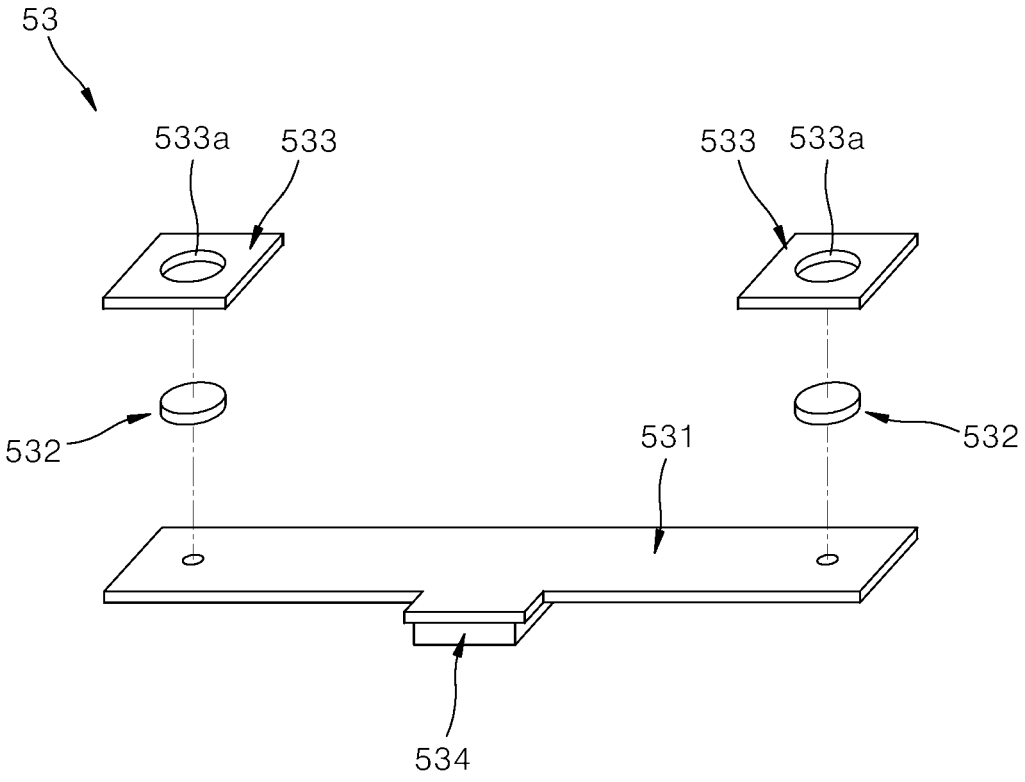
FIG. 10 is an exploded perspective view of a microphone module.
Figure 11:
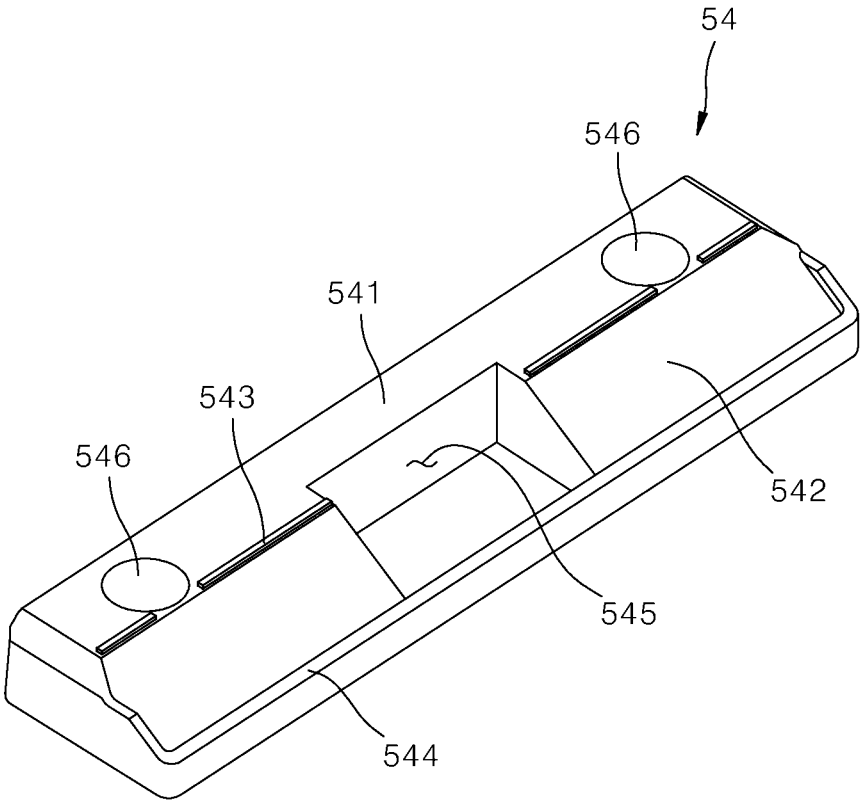
FIG. 11 is a perspective view of a microphone supporter according to an implementation of the present disclosure.
Figure 12:
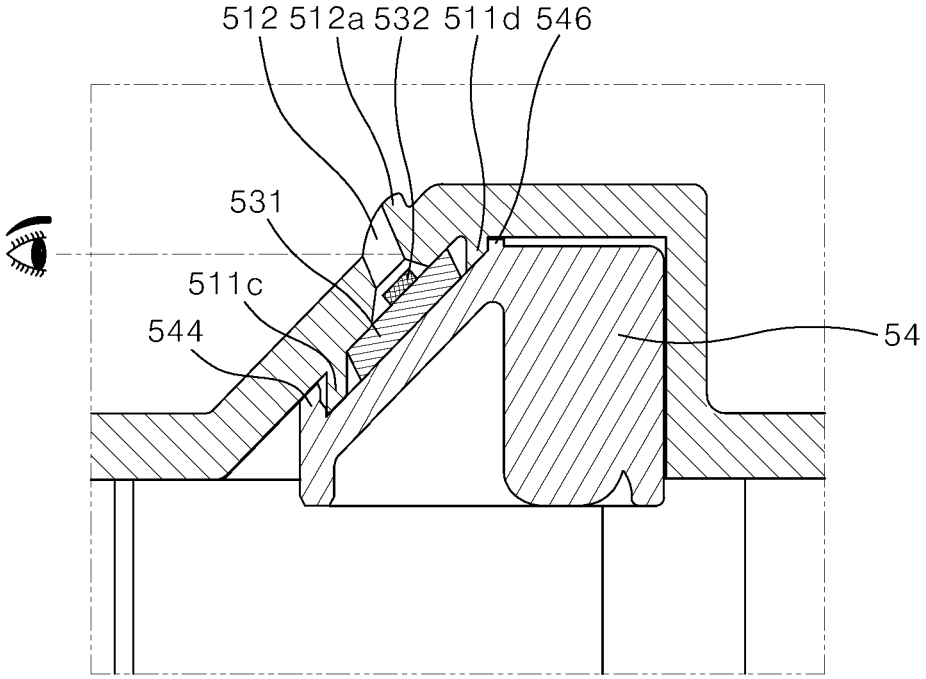
FIG. 12 is a partially enlarged view of a coupling structure of a microphone module and a microphone supporter by cutting a microphone hole.
Figure 13:
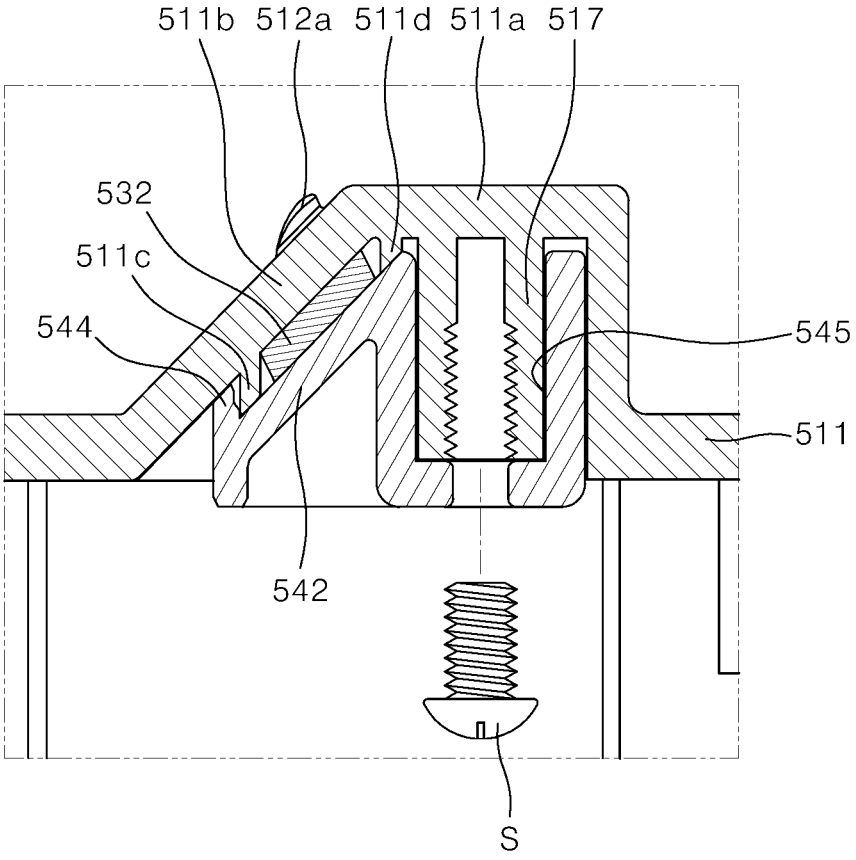
FIG. 13 is a partially enlarged view of a state in which a microphone module and a microphone supporter are coupled by cutting a microphone mounting boss.
Figure 14:
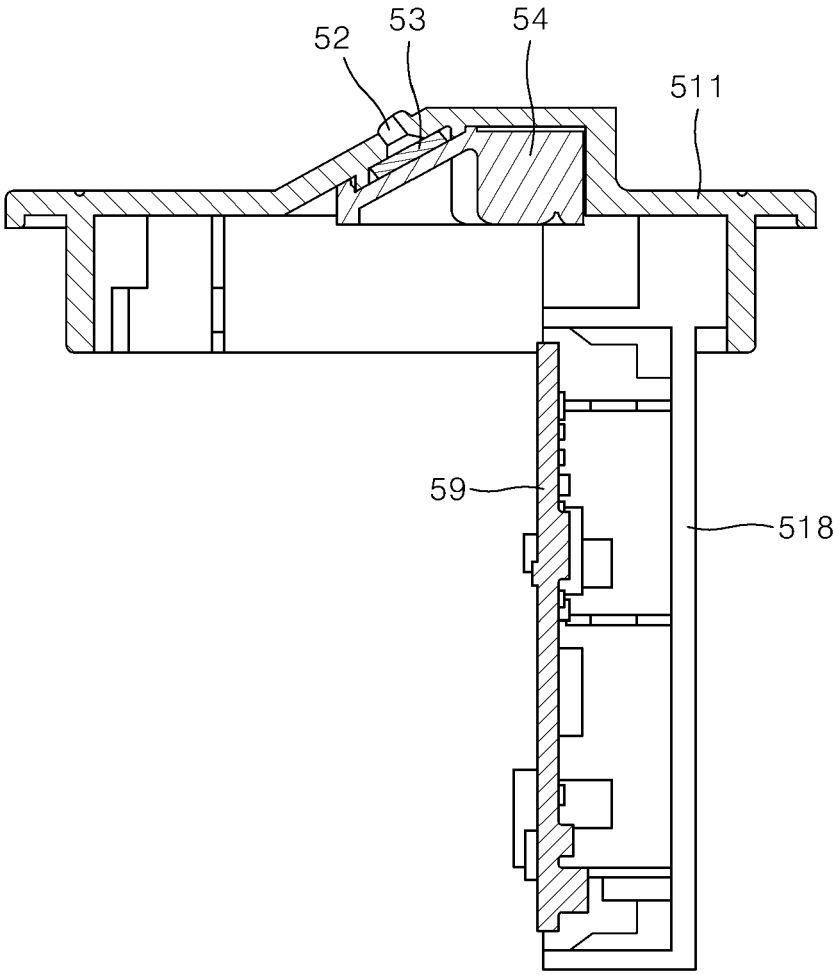
FIG. 14 is a side cross-sectional view of a microphone mount by cutting a part in which a substrate is installed.
Figure 15:
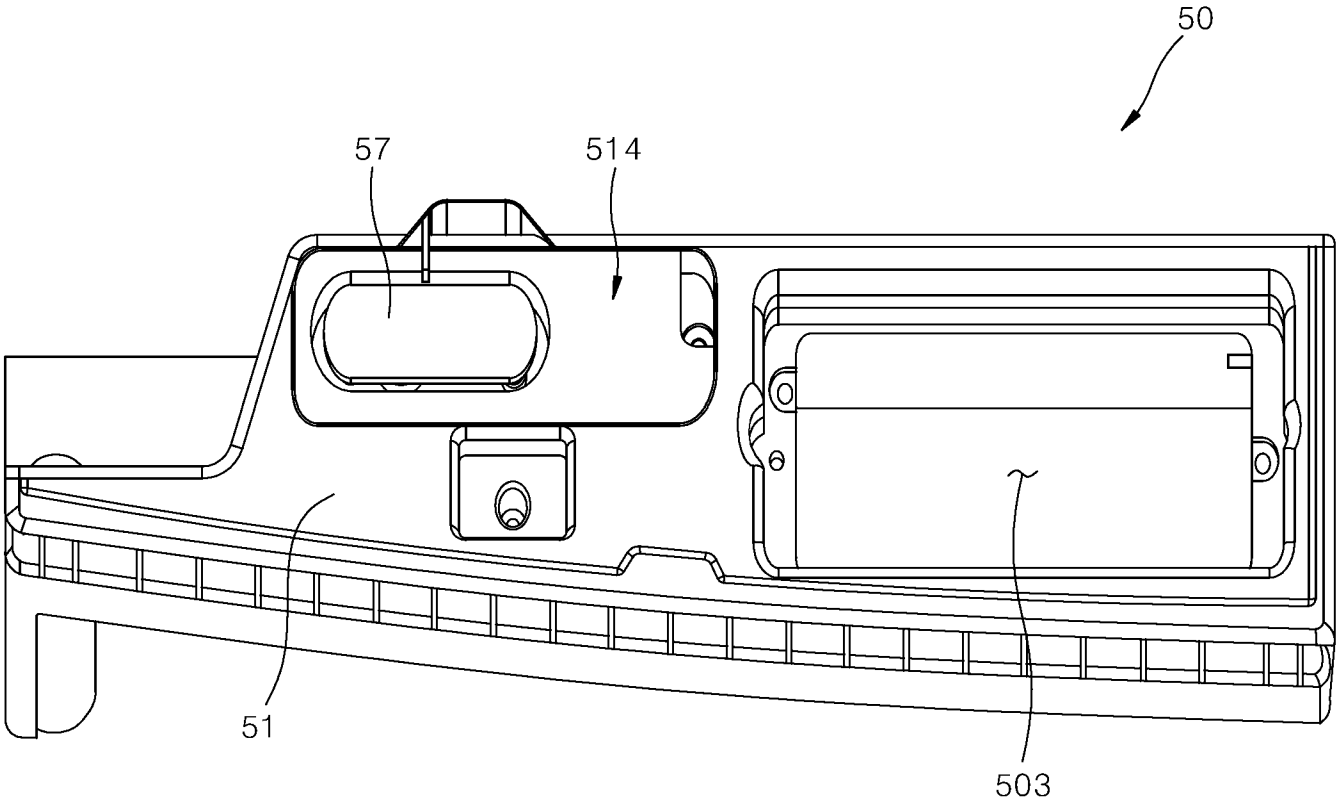
FIG. 15 is a top perspective view of a state in which a speaker mount is installed in a speaker accommodator of a door cover of a cab deco.
Figure 16:
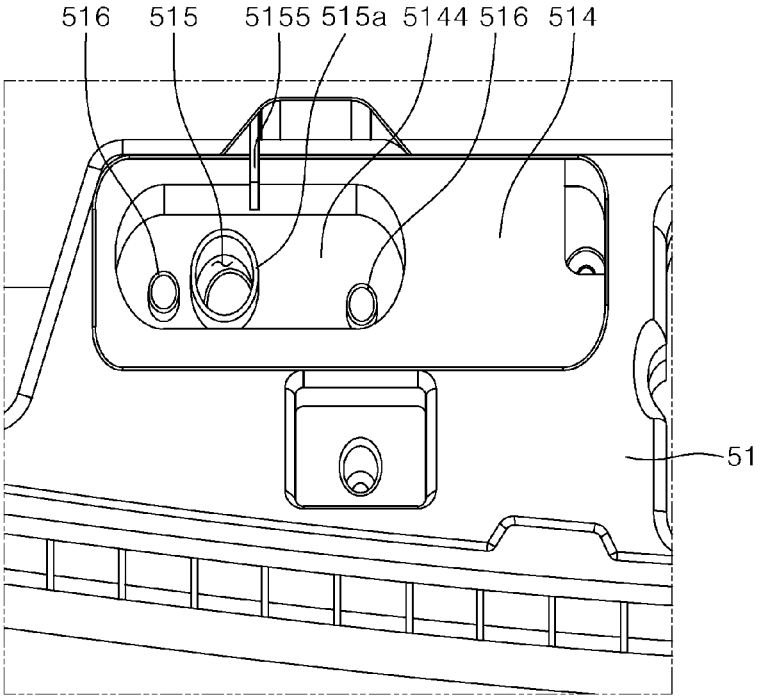
FIG. 16 is an enlarged view of a state in which the speaker cover is removed from the speaker mount of FIG. 15.
Figure 17:
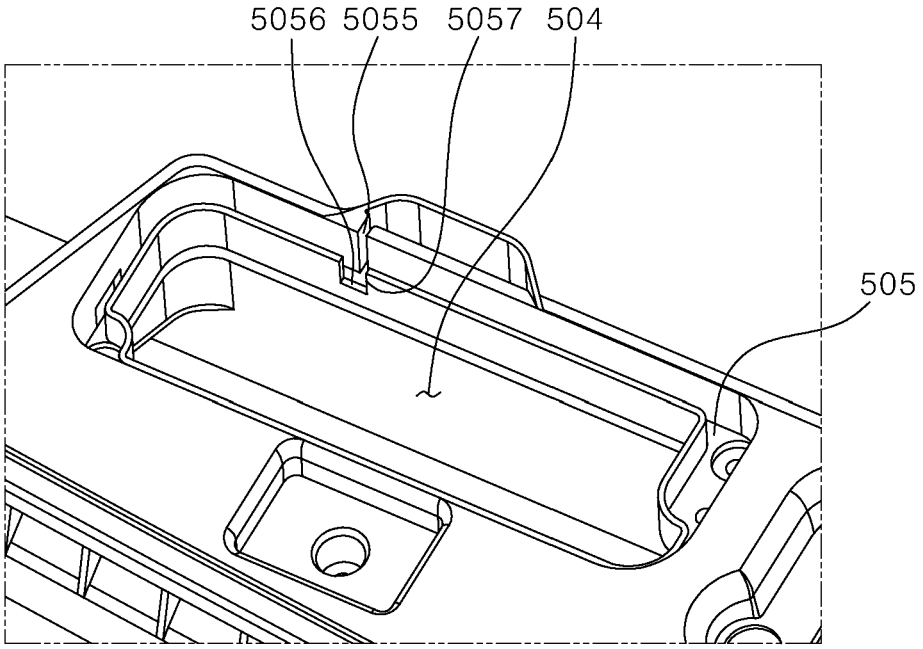
FIG. 17 is an enlarged view of a speaker accommodator of a cab deco.
Figure 18:
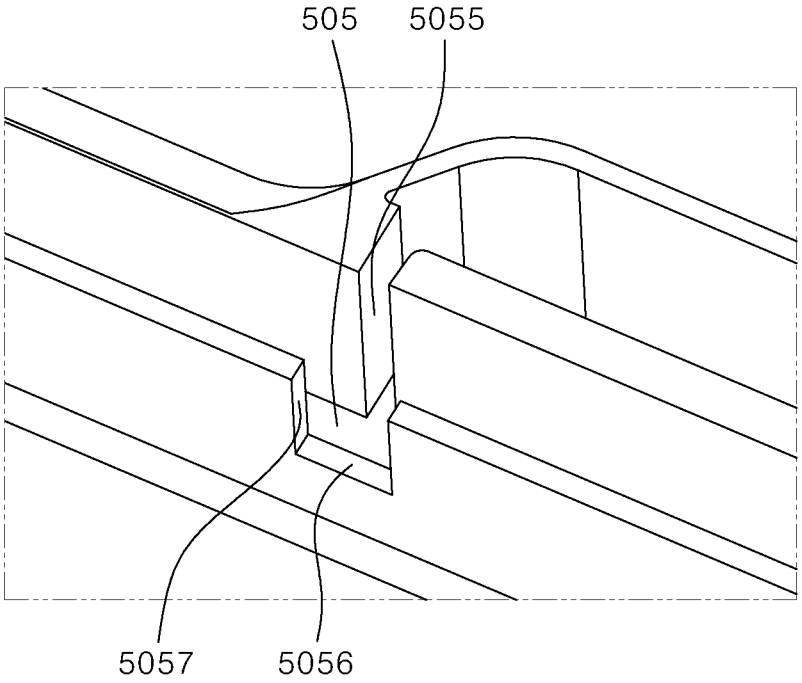
FIG. 18 is an enlarged view of a first drainage groove of FIG. 17.
Figure 19:
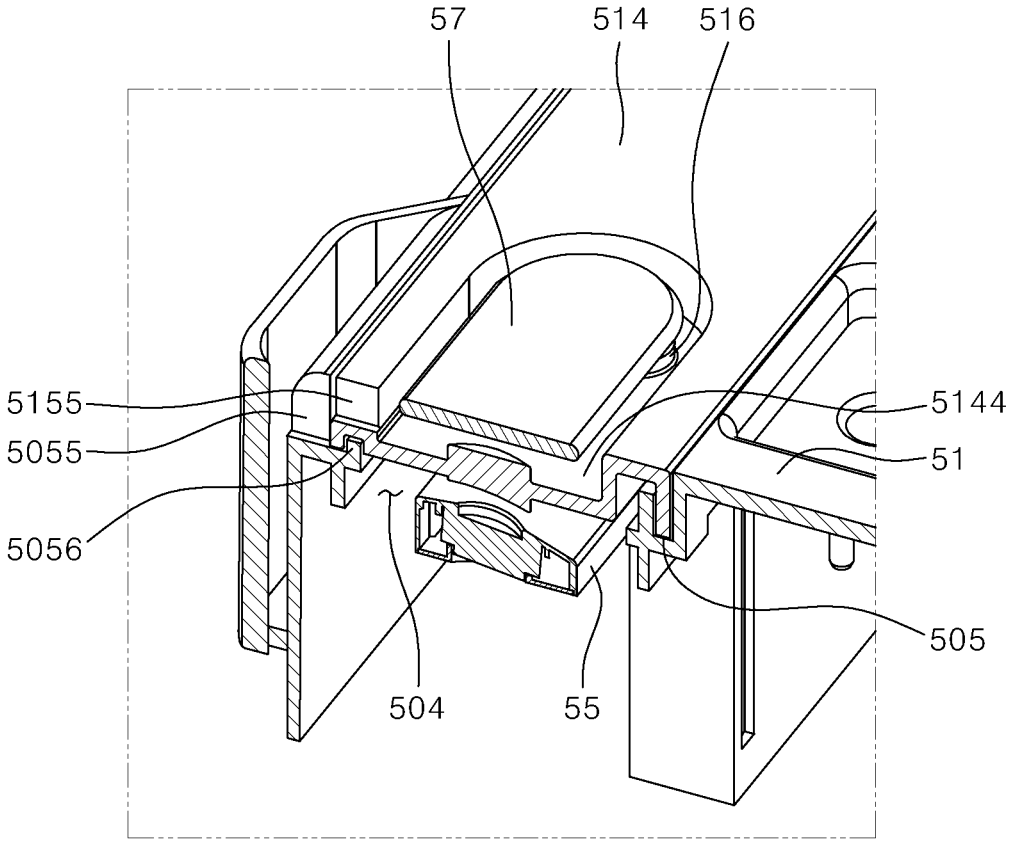
FIG. 19 is a side cross-sectional perspective view of a state in which a speaker mount is installed in a speaker accommodator of a door cover of a cab deco.
Figure 20:
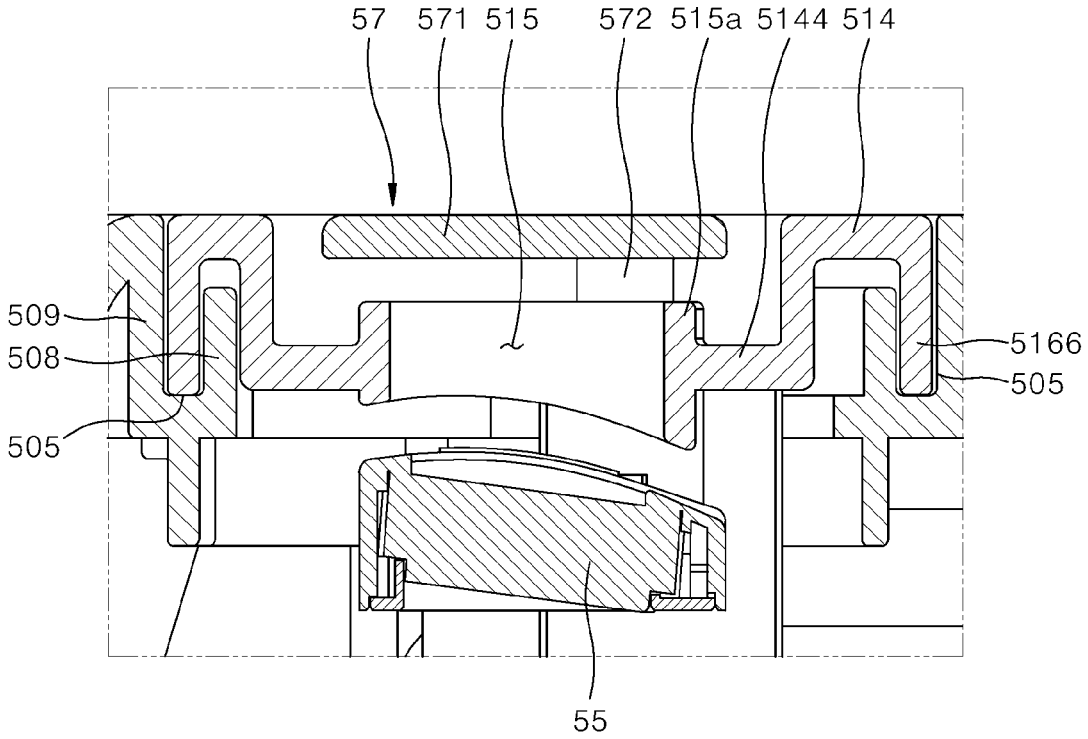
FIG. 20 is a side cross-sectional view of a speaker hole when a speaker mount is installed in a speaker accommodator.
Figure 21:
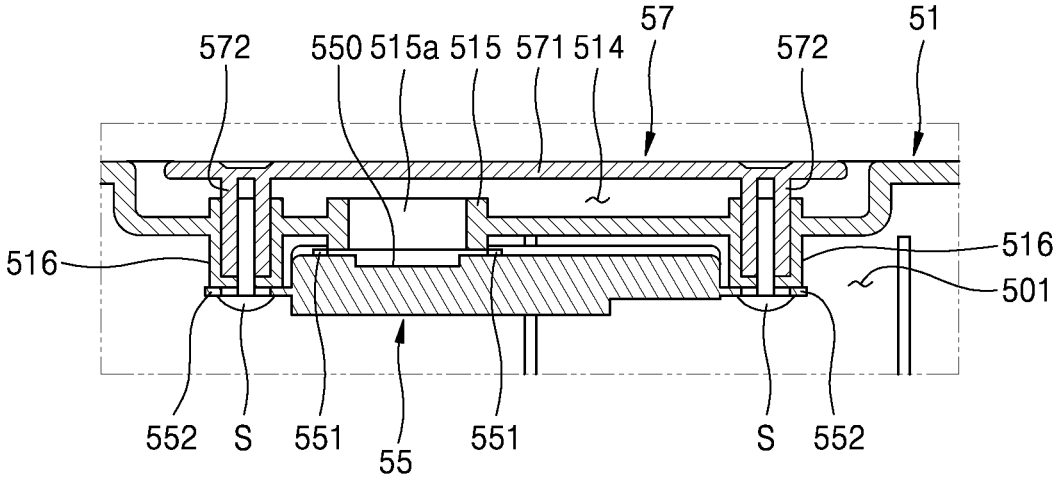
FIG. 21 is a front cross-sectional view of the speaker hole and the speaker mounting boss when the speaker mount is installed in the speaker accommodator.
Figure 22:
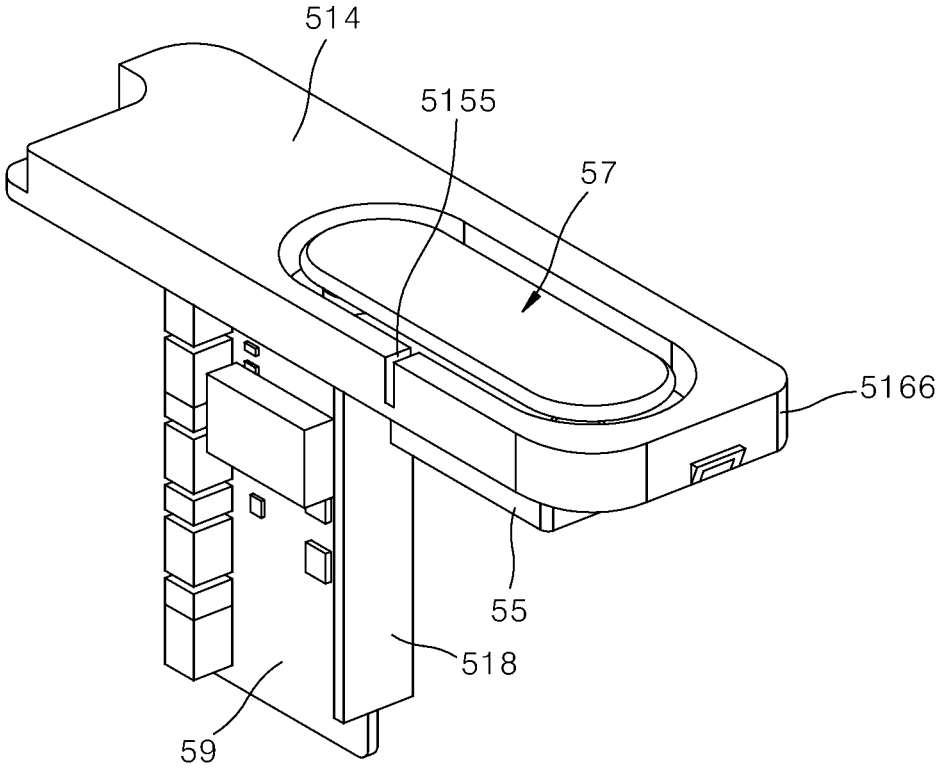
FIG. 22 is a rear, upper perspective view of a speaker mount.
Figure 23:
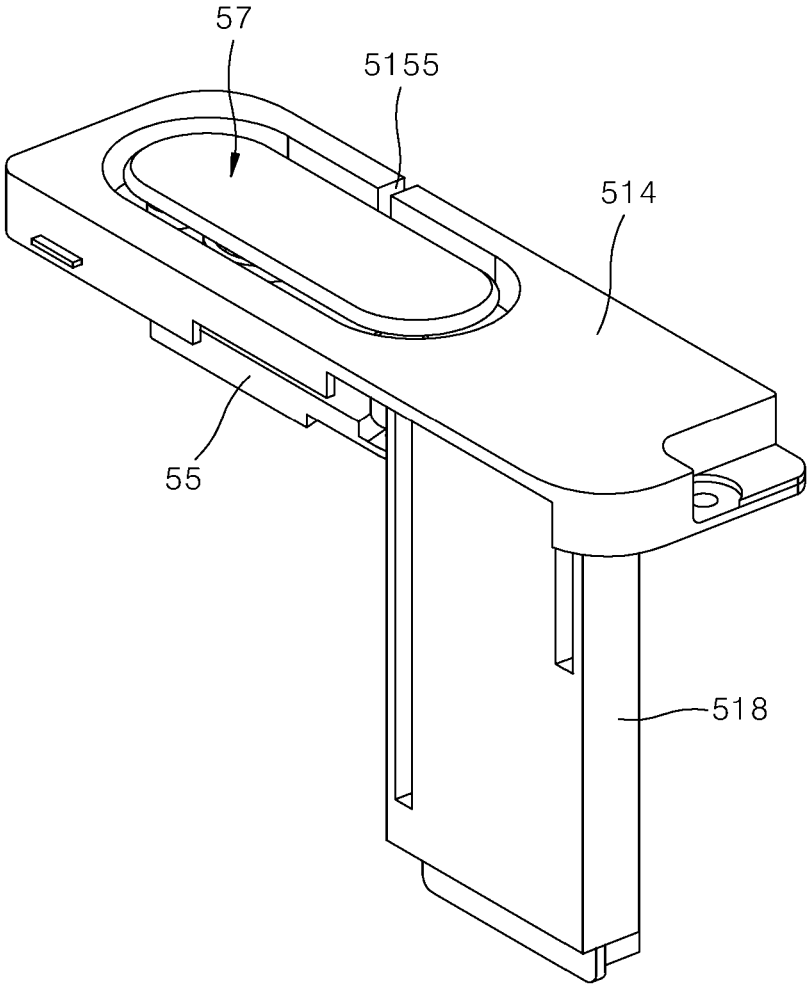
FIG. 23 is a front, upper perspective view of a speaker mount.
Figure 24:
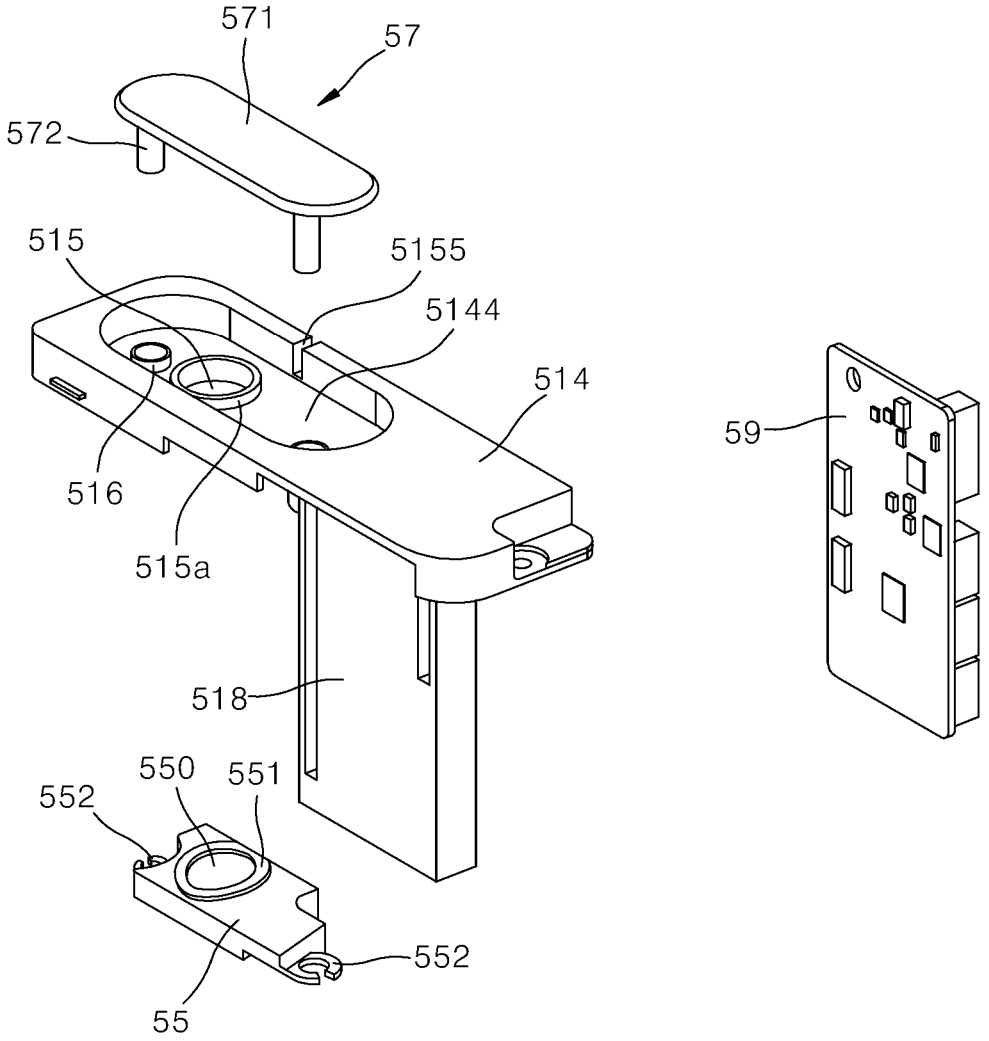
FIG. 24 is an exploded perspective view of the speaker mount of FIG. 23.
Figure 25:
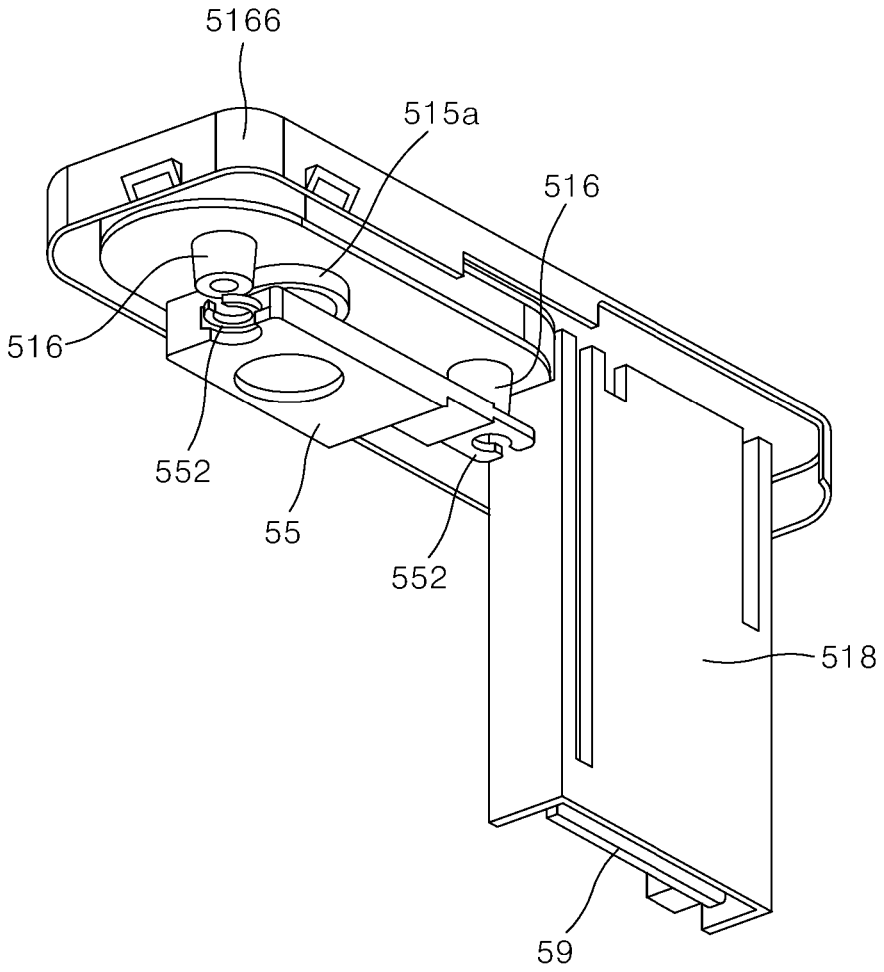
FIG. 25 is a lower front perspective view of a speaker mount.
Figure 26:
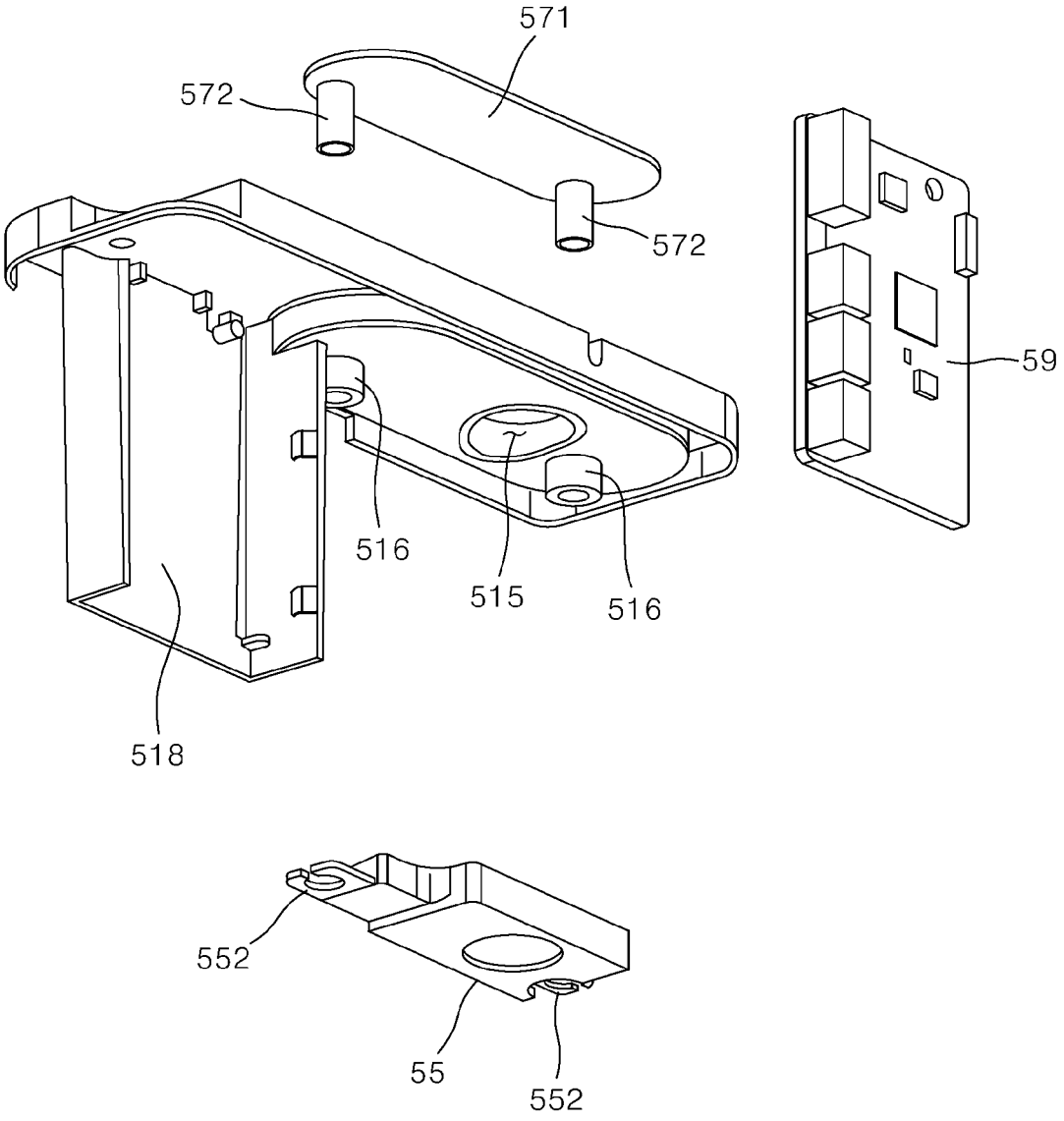
FIG. 26 is an exploded perspective view of a rear lower portion of the speaker mount.

The inclination 511*b* may be formed at a front end of the microphone mount 511 and may have an inclination downward as it extends toward the front. The inclination 511*b* may have an inclination of 30° to 50°. The inclination 511*b* may connect the front end of the protrusion 511*a* to the surface 513 of the microphone mount 511 (see FIG. 8).

The protrusion 511*a* may have a rectangular shape elongated laterally. A vertical wall member may be connected to the remaining three ends of the rectangle to which the inclination 511*b* is not connected and both ends of the inclination 511*b*. The lower end of the vertical wall member may be connected to the surface of the microphone mount 511. The microphone module 53 and the microphone supporter 54 may be arranged in an inner space defined by the protrusion 511*a* and the inclination 511*b*.

The inclination 511*b* may have a size and a shape corresponding to the microphone module 53 such that the microphone module 53 may closely contact the rear surface of the inclination 511*b*. A front rib 511*c* and a rear rib 511*d* that fix the microphone module 53 may protrude downward from the rear surface of the inclination 511*b*, respectively. The front rib 511*c* and the rear rib 511*d* may extend at the front end and the rear end of the inclination 511*b* respectively in a lateral direction. The microphone module 53 may be disposed between the front rib 511*c* and the rear rib 51.

The microphone module 53 may be mounted at an accurate position by the front rib 511*c* and the rear rib 511*d* so that the microphone hole 512 formed in the inclination 511*b* may be aligned at a position corresponding to the microphone element 532 of the microphone module 53.

The microphone hole 512 may be formed at the inclination 511*b*. The microphone hole 512 may connect the inner space of the microphone mount 511 defined by the protrusion 511*a* and the inclination 511*b* and a space in front of the inclination 511*b*. The microphone hole 512 may be formed at a position corresponding to the center of the microphone element 53 so that the voice input of the user may be effectively inputted to the microphone element through the microphone hole 512.

The pair of microphone holes 512 may be provided on both left and right sides of the inclination 511*b*. That is, a pair of microphone elements 532 corresponding to the pair of microphone holes 512 may also be provided, and the sound having passed through the pair of microphone holes 512 may be inputted to the microphone elements 532.

A pair of microphone holes 512 and the pair of microphone elements 532 may be formed at both sides of the inclination with a distance of about 3 cm to 10 cm in consideration of a general position of the user. Analysis and processing of the speech inputted to the microphone element 532 through the pair of microphone holes 512 spaced apart from each other by the determined distance may be more effectively performed, so that the speech recognition rate may be improved.

A hole guide 512*a* may be formed at a circumference of the microphone hole 512. The hole guide 512*a* may protrude along the circumference of the microphone hole 512 and may protrude from the inclined surface. The protrusion of the hole guide 512*a* may decrease toward a bottom of the inclined surface. Accordingly, when dust or the foreign substance falls from above, the dust or the foreign substance may not be directly introduced into the microphone hole 512 by the hole guide 512*a*. Further, although the microphone hole 512 may be formed on the inclination 511*b*, an end of the hole guide 512*a* may have a greater angle than the inclination 511*b*, so that the speech of the user may be more effectively transmitted to the microphone hole 512.

The microphone hole 512 may face the front upper portion of the inclination 511*b*. The voice input of the user may be spoken in front of the door 21. As the height of the upper end of the door 21 may be greater than the height of the mouth of the user, most of the speech transmitted to the microphone hole 512 may be reflected from the ceiling. As an opening direction of the microphone hole 512 is directed to the front upper portion thereof, the speech of the user may be collected more reliably. When the microphone hole 512 is viewed in a horizontal direction in front of the microphone hole 512, as the microphone hole 512 penetrates upward as it goes forward, the inner space of the microphone mount 511 may not be exposed.

As the hole guide 512*a* is formed at the circumference of the microphone hole 512 and surrounds the rear side and the lateral side of the microphone hole 512, the speech of the user may be guided into the microphone hole 512, and it may be possible to prevent the sound outputted from the speaker module 55 from being introduced back into the microphone element 532. Further, the hole guide 512*a* may prevent the dust or the foreign substance introduced along the inclination 511*b* from being introduced into the microphone hole 512 and blocking the microphone hole. The speech output 550 of the speaker mounting unit 514 mounted on the upper cover 51 and the microphone hole 512 of the microphone mount 511 may be arranged apart from each other by at least 85 mm to 200 mm.

The microphone module 53 may include a microphone substrate 531, a microphone element 532, and a sealing member or seal 533. The microphone substrate 531 may allow the microphone elements 532 to be spaced from each other by a predetermined distance and supported thereon and may allow the microphone element 532 to be arranged at a predetermined distance. The microphone substrate 531 may have a shape of a rectangular plate extending in the transverse direction thereof to be mounted on the inclination 511*b* of the microphone mount 511.

A microphone connector 534 may be provided at a central region of a lower surface of the microphone substrate 531 and the microphone connector 534 may protrude downward to be inserted into the connector hole 545 of the microphone supporter 54. Therefore, the microphone connector 534 may be connected to the substrate 59 by a harness to which a connector is connected at both ends thereof.

As the harness passes through the connector hole 545, the microphone connector 534 and the substrate 59 may be connected to each other without being interfered by the microphone supporter 54. The substrate 59 may be installed in the microphone mount 511 to minimize the length of the harness, thereby minimizing the occurrence of noise. The substrate 59 may also be connected to a main PCB 11, which is a controller, by another harness having connectors connected at both ends thereof.

The voice input may be is inputted to the microphone element 532 and the microphone element 532 may be mounted at both sides of the upper surface of the microphone substrate 531. The microphone element 532 may be mounted on the substrate 531 so that the position of the microphone element 532 may be reliably fixed to the substrate 531, and an alignment of the microphone element 532 with the microphone hole 512 may be accurately performed.

The microphone element 532 may be connected to the microphone substrate 531 by a cable. It may then be possible to minimize the influence of the vibration of the microphone substrate 531 on the microphone element 532 through a flexible property of the cable. The microphone element 532 connected to the substrate 531 may be provided at a position corresponding to the microphone hole 512 when the microphone module 53 is mounted. Therefore, the voice input, of the user introduced into the microphone hole 512 may be detected by the microphone module 53.

An element having various types of structures capable of inputting the voice input of the user may be used as the microphone element 532. Of course, various types of apparatuses capable of receiving the speech input may be used as the microphone element 532. Thus, the microphone element 532 may be referred to as a microphone or a microphone apparatus.

The sealing member 533 may be arranged on the microphone substrate 531 at both sides thereof and may be formed in a donut sheet shape so as to surround the microphone element 532 and the microphone hole 512. The sealing member 533 may be arranged at both ends of the microphone substrate 531 and may be closely contacted between the microphone substrate 531 and the inclination 511*b* of the microphone mount 511.

The sealing member 533 may be made of a material having elasticity and may be adhered to the upper surface of the microphone substrate 531 and the lower surface of the inclination 511*b*. A soft adhesive tape or double-sided tape may be used as the sealing member 533.

A hole 533*a* may be formed at a center of the sealing member 533 and the microphone element 532 may be disposed inside of the hole 533*a*. The thickness of the sealing member 533 may be greater than the thickness of the microphone element 532. Therefore, when the microphone module 53 is pushed by and mounted on the microphone supporter 54, the sealing member 533 may completely seal the circumference of the microphone element 532, thereby basically preventing noise from being introduced into the microphone element 532.

Particularly, the sealing member 533 may effectively absorb the impact or the vibration generated when the door 22 is opened and closed due to the property of the use environment of the door 22, and maintain and seal a position at which the microphone module 53 is mounted, thereby maintaining an excellent speech recognition rate. Further, vibrations or impact generated from the cabinet 10 and transmitted to the microphone element 532 during operation of the refrigerator 1 may be further absorbed.

A microphone supporter 54 may be fixed to the microphone mount 511 so that the microphone module 53 remains fixed to the inclination 511*b* of the door cover 51. An upper surface of the microphone supporter 54 may include a mounting surface 541 and a support surface 542.

The mounting surface 541 may be configured to mount the microphone supporter 54 and may be parallel to a lower surface of the protrusion 511*a* of the microphone mount 511. A pair of supporter through-holes 546 opened upward may be provided at both sides of the mounting surface 541. The supporter through-holes 546 may extend in the vertical direction. The microphone mounting boss 517 may be inserted downward into the supporter through-hole 546 through the upper portion of the supporter through-hole 546. A screw S may be press-fitted upward from the lower portion of the supporter through-hole 546 and may be fastened to the microphone mounting boss 517.

The support surface 542 may be formed at a front end of the mounting surface 541, and may be inclined downward toward a front of the microphone supporter 54. The support surface 542 may have a size such that the microphone module 53 is mounted on the support surface 542 and may have a slope corresponding to the inclination 511*b* of the microphone mount 511. Therefore, the microphone module 53 may be arranged between the inclination 511*b* and the support surface 542.

An upper rib 543 in contact with the rear rib 511*d* may be formed at a rear end of the support surface 542. The front end of the support surface 542 may include a lower rib 544 in contact with the front rib 511*c*.

The lower rib 544 may have a predetermined height and may form an upward extending protruding part along a part of the front side and the side of the microphone supporter 54. The front rib 511*c* and the rear rib 511*d* may be arranged between the upper rib 543 and the lower rib 544 when the microphone supporter 54 is mounted on the microphone mount 511. The microphone supporter 54 and the microphone module 53 may be guided such that the microphone supporter 54 and the microphone module 53 may be mounted at a correct position by the supporter through-hole 546, the microphone mounting boss 517, and a plurality of ribs 511*c*, 511*d*, 543, and 544.

A connector hole 545 may be formed at the center of the microphone supporter 54. The connector hole 545 may be provided at a central portion of the support surface 542 that extends laterally. The microphone connector 534 may be exposed downward through the connector hole 545 when the microphone module 53 is mounted on the support surface 542. Therefore, even when the microphone module 53 is fixed to the door cover 51, the microphone module 53 may be connected to the substrate 59 by a cable.

A substrate 59 may be suspended from a lower portion of the microphone mount 511. The substrate 59 may be fixed to a substrate mount 518 and the substrate mount 518 may be fixed to the microphone mount 511.

The substrate mount 518 may have a case shape, which is rectangular parallelepiped, that is long in a vertical direction thereof and has a low depth in a front and rear direction thereof and is opened forward or rearward. A boss that restricts a position of the substrate 59 and a hook structure that prevents the substrate 59 from being detached from the substrate mount 518 after the substrate 59 is mounted on the substrate mount 518 may be provided on an inner wall surface of the substrate mount 518.

A speech or voice signal inputted to the microphone element 532 may be processed by a controller on the substrate 59. The substrate 59 may be arranged close to the microphone substrate 531 so that the length of an electrical connection path between the microphone element 532 and the substrate 59 may be shortened, thereby minimizing a probability that noise is inserted into the signal detected by the microphone element 532.

The substrate mount 518 may be installed at the microphone mount 511 in a standing manner. Accordingly, the substrate 59 may also be installed at the microphone mount 511 in a standing manner. A network function may also be added to the refrigerator. As the substrate 59 is installed at the door 21, when a communication module (e.g., a Wi-Fi chip) is installed at the substrate 59, sensitivity of the transmitted and received signal may be increased. Further, when the substrate 59 is installed at the microphone mount in a vertical manner, the sensitivity of the transmitted and received signal may be further enhanced.

The substrate mount 518 may be detachably mounted on the microphone mount 511. Therefore, components may be shared even for a refrigerator that does not require mounting of the substrate 59 onto the microphone mount 511.

Figure 7:
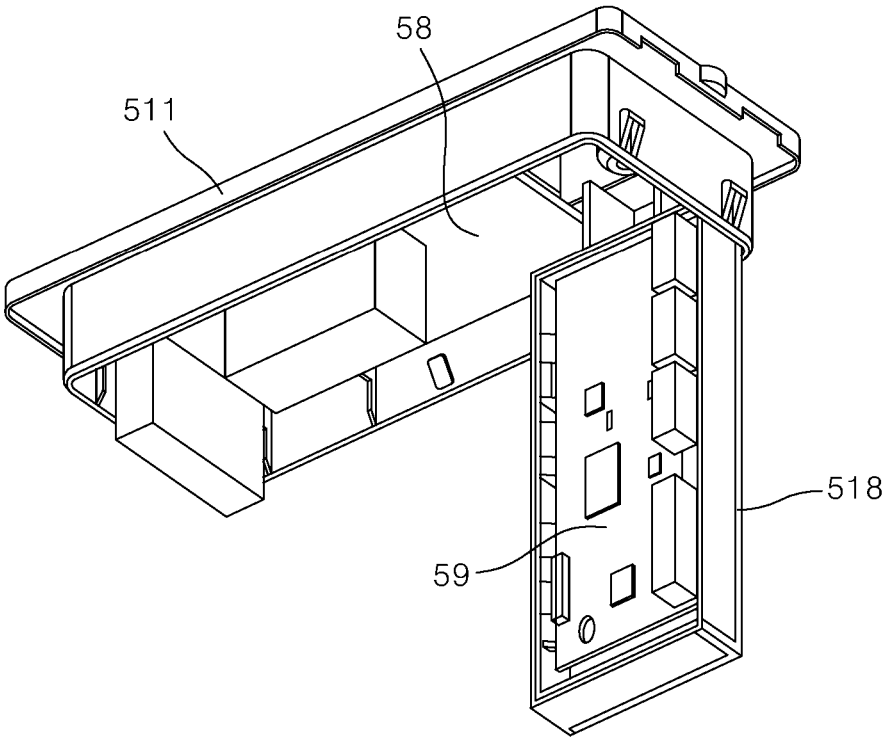
FIG. 7 shows a state in which another substrate is further installed on the microphone mount of FIG. 4.

The substrate 58 that may control the operations of the ice maker 25 and/or a dispenser 23 and/or a second display 231 may be further installed in an available space provided at the bottom of the microphone mount 511 due to the vertical installation of the substrate mount 518 (see FIG. 7). When the substrate 58 is installed in the microphone mount 511, the components may be shared between the models having different specification from each other, and maintenance or after service related to the ice maker 25 and/or the dispenser 23 and/or the second display 231 may be more convenient.

Hereinafter, a sequence of assembling a microphone mount will be described. First, a microphone module 53 may be attached to a support surface 542 of the microphone supporter 54. Then, the microphone connector 534 may be arranged inside the connector hole 545.

Then, the microphone supporter 54 having the microphone module 53 mounted thereon may be arranged in an inner space of the microphone mount 511. At this time, when the microphone mounting boss 517 and the supporter through-hole 546 are fitted to each other, a mounting surface 541 of the microphone supporter 54 may be aligned with a lower surface of a protrusion 511*a* of the microphone mount 511.

When the screw S is fastened under the microphone supporter 54, the screw S may be fastened to the microphone mounting boss 517 through the supporter through-hole 546.

As the screw S is tightened, the microphone supporter 54 further enters the inner space of the microphone mount 511. The upper rib 543 and the lower rib 544 may contact the front rib 511*c* and the rear rib 511*d* at the outer sides of the front rib 511*c* and the rear rib 511*d*, respectively. Therefore, the microphone supporter 54 may be more accurately aligned. As a result, the microphone element 532 of the microphone module 53 and the microphone hole 512 may be aligned with each other.

The microphone module 53 may be provided in a space between the front rib 511*c* and the rear rib 511*d*. The sealing member 533 of the microphone module 53 may seal between the microphone substrate 531 and the lower surface of the inclination 511*b*.

When the screw S to mount the microphone supporter 54 is completely fastened, the microphone supporter 54 may push the microphone module 53 toward the lower surface of the inclination 511*b*. Accordingly, as the sealing member 533 is compressed, the space between the microphone substrate 531 and the rear surface of the inclination 511*b* may be sealed.

Therefore, the speech introduced into the microphone hole 512 may be completely transmitted to the microphone element 532 without leakage. Further, unnecessary noise may be prevented from being introduced into the microphone element 532.

The microphone hole 512 may have a greater diameter as it goes from the upper surface opened thereof to the lower surface thereof, that is, the microphone hole 512 may be close to the microphone element 532 so that the speech introduced into the microphone hole 512 may be effectively transmitted to the microphone element 532, thereby minimizing an occurrence of the noise.

After the microphone supporter 54 is mounted on the microphone mount 511, the substrate mount 518 may be installed under the microphone mount 511. A substrate 59 may be mounted on the substrate mount 518. The microphone connector 534 of the microphone substrate 531 and the substrate 59 may be connected by a harness.

The door cover 51 may include a speaker pocket 504 in which a speaker mount 514 having the speaker module 55 mounted is installed. The speaker module 55 may be mounted under the speaker mount 514.

The speaker mount 514 may have a depression 5144 depressed downward from the surface thereof. The speaker module 55 may be fixed to a lower surface of the speaker depression 5144.

A circular speaker hole 515 may be formed at a center of the depression 5144 of the speaker mount 514 and an annular protruding part 515*a* may be formed at a circumference of the speaker hole 515. The protruding part 515*a* may protrude both upward and downward. Dust or foreign substances introduced into the depression 5144 of the speaker mount 514 may be shielded by the rim or the upper portion of the protruding part 515*a* and may not be introduced into the speaker module 55. The protruding part may have a height such that the protruding part does not contact the speaker cover 57 upward and the protruding part does not directly contact the speaker module 55 downward.

A sound output module 550 of the speaker module 55 may be arranged in an inner area of the protruding part 515*a*, that is, a position corresponding to the speaker hole 515. Thus, the sound outputted from the sound output module 550 may not leak into the door 21 but may be outputted to an outside through the speaker hole 515.

A pair of speaker mounting bosses 516 extending downward may be formed on the depression 5144 of the speaker mount 514. The speaker mounting boss 516 may be formed at both sides of the speaker hole 515. The lower end of the speaker mounting boss 516 may face the speaker fastener 552 on both sides of the speaker module 55. A sound absorbing washer capable of absorbing vibration may be interposed between the speaker mounting moss 516 and the speaker fastener 552 to prevent the vibration of the speaker module 55 from being transmitted to the speaker mounting boss 516.

A speaker cover 57 may be mounted on an upper portion of the depression 5144 of the speaker mount 514. The speaker cover 57 may include a track-shaped plate 571 and a columnar speaker boss 572 extending downward from the plate 571. The plate 571 may have a plate shape and may correspond to the speaker mount 514, and may have a slightly smaller size than the speaker mount 514. The plate 571 and the depression 5144 may have a track or oval shape.

When the speaker cover 57 is mounted on the speaker mount 514, a circumference of an inner circumferential surface of the depression 5144 of the speaker mount 514 and the edge of the circumference of the plate 571 of the speaker cover 57 may be spaced apart from each other. The sound outputted from the speaker module 55 may be released through the spaced-apart space.

The speaker boss 572 extending downward may be formed on a lower surface of the plate 571 of the speaker cover 57. The speaker bosses 572 may have an interval corresponding to the speaker mounting bosses 516 and may be provided at positions corresponding to positions of the speaker mounting bosses 516.

The speaker mounting boss 516 may be opened upward and may extend further downward from the lower surface of the depression 5144. The speaker boss 572 may be inserted downward from the top of the speaker mounting boss 516 into the speaker mounting boss 516. An inner diameter of the speaker mounting boss 516 may correspond to an outer diameter of the speaker boss 572. The lower end of the speaker boss 572 may be inserted downward until the lower end of the speaker boss 572 contacts the bottom of the speaker mounting boss 516, so that amount of insertion of the speaker boss 572 may be controlled.

When the screw S is fastened upward when the speaker fastener 522 of the speaker module 55 contacts the lower end of the speaker mounting boss 516, the speaker fastener 522 may be coupled to the speaker boss 572 by a screw through the bottom of the speaker mounting boss 516.

The speaker mounting boss 516 may also protrude upward slightly from the upper surface of the depression 5144 to prevent foreign substances such as liquid from being introduced into the inside of the speaker accommodator 504 through the opening of the speaker mounting boss 516.

The speaker module may be arranged under the depression 5144 of the speaker mount 514. At this time, the sound output module 550 that outputs sound may be provided in the speaker module 55. The sound output module 550 may be arranged at a position facing the speaker hole 515. An output guide 551 may be provided at a circumference of the sound output module 550. The output guide 551 may be made of a soft material, and may be made of a material that absorbs vibration. The output guide 551 may contact the lower end of the protruding part 515*a* formed at the speaker mount 514.

In other words, the lower end of the protruding part 515*a* may contact the output guide 551 without directly contacting a main body of the speaker module 55. Therefore, the sound outputted from the sound output module 550 may be prevented from being completely and directly transmitted to the outside through the speaker hole 515, and the vibration of the speaker module 55 from being directly transmitted to the protruding part 515*a*.

The speaker cover 57 may be provided in the depression 5144 of the speaker mount 514 and the speaker boss 572 may be inserted into the speaker mounting boss 516. The screw S that is fastened at the lower portion of the speaker fastener 552 through the speaker fastener 552 may be coupled to the speaker boss 572 to fix the speaker cover 57 and the speaker module 55 at the same time.

The plate 571 may be arranged on the same plane as the speaker mount 514 when the speaker cover 57 is mounted on the speaker mount 514. The surface of the speaker mount 514 may be arranged on the same plane as the door cover 51. The sound outputted from the speaker module 55 may be released through a space provided between the plate 571 and the depression 5144.

A ditch groove 505 may be provided at a protruding part of the speaker accommodator 504 on which the speaker mount 514 is installed. The ditch groove 505 may be defined by a groove between an outer member 509 and an inner member 508 of the upper cover 51 arranged inward from the outer member 509. A fitting part 5166 fit to the ditch groove 505 may be provided at the outer edge of the speaker mount 514. The fitting part 5166 may extend downward from the speaker mount 514 and may be inserted downward into the ditch groove 505 from above.

The speaker mount 514 may include a second drainage groove 5155 which is opened from a side wall of the depression 5144 to the fitting part 5166. The second drainage groove 5155 may have a bottom lower than the protruding part 515*a*. The height of the bottom of the second drainage groove 5155 may be identical to the height of the bottom of the depression 5144. The second drainage groove may be a drainage path through which liquid may flow when the liquid is introduced into the depression 5144.

The inner member 508 and the outer member 509 that define the ditch groove 505 of the speaker accommodator 504 may have a structure corresponding to the second drainage groove 5155. The inner member 508 may have a fitting groove 5057 that accommodates a shape of the second drainage groove 5155 provided on the side wall of the depression 5144. A threshold 5056 slightly protruding upward from the bottom of the ditch groove 505 may be provided at the lower portion of the fitting groove 5057. The threshold 5056 may prevent the liquid introduced into the ditch groove 505 from being introduced into the door.

The outer member 509 may include a first drainage groove 5055. The first drainage groove 5055 may be provided at a position corresponding to the second drainage groove 5155 to provide a connected drainage groove shape. Therefore, the liquid introduced into the depression 5144 may be discharged to the outside of the door through the second drainage groove 5155 and the first drainage groove 5055. The first and second drainage grooves 5055 and 5155, along with the fitting groove 5057, may form a drainage path.

The substrate 59 may be suspended from the lower portion of the speaker mount 514. The substrate 59 may be fixed to the substrate mount 518 and the substrate mount 518 may be fixed to the speaker mount 514. The substrate 59 may be mounted on the speaker mount 514 instead of the microphone mount 511 or the substrate 59 may be mounted on both the microphone mount 511 and the speaker mount 514.

The substrate mount 518 may have a shape of a rectangular parallelepiped case that is long in the vertical direction thereof and has a low depth in the front and rear direction thereof and is opened forward or rearward. A boss that restricts the position of the substrate 59 and a hook structure that prevents the substrate 59 from being detached from the substrate mount 518 after the substrate 59 is mounted on the substrate mount 518 may be provided on the inner wall surface of the substrate mount 518.

The substrate mount 518 may be installed at the speaker mount 514 in a vertical form thereof. Accordingly, the substrate 59 may also be installed at the speaker mount 514 in a vertical form thereof. A network function may be added to the refrigerator. As the substrate 59 is installed at the door 21, when a communication module (e.g., a Wi-Fi chip) is installed on the substrate 59, sensitivity of the transmitted and received signal may be enhanced. Further, when the substrate 59 is installed at the speaker mount 514 in a vertical form thereof, it may be possible to further enhance the sensitivity of the transmitted and received signal.

The substrate mount 518 may be detachably mounted at the speaker mount 514. Therefore, components may be shared for a refrigerator that does not require mounting of the substrate 59.

Figure 4:
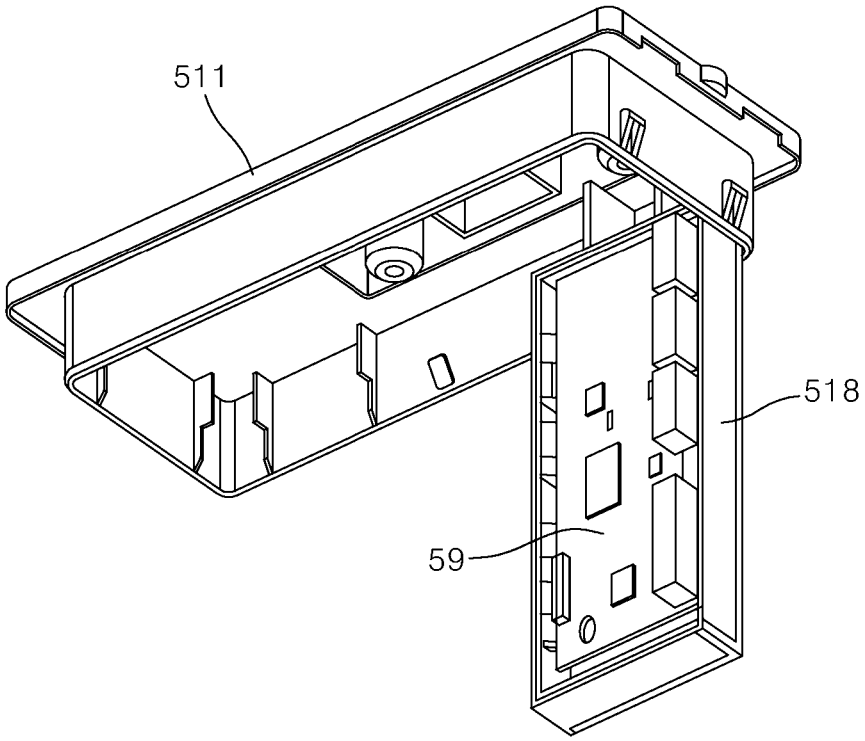
FIG. 4 is a bottom perspective view of a microphone mount.
Figure 5:
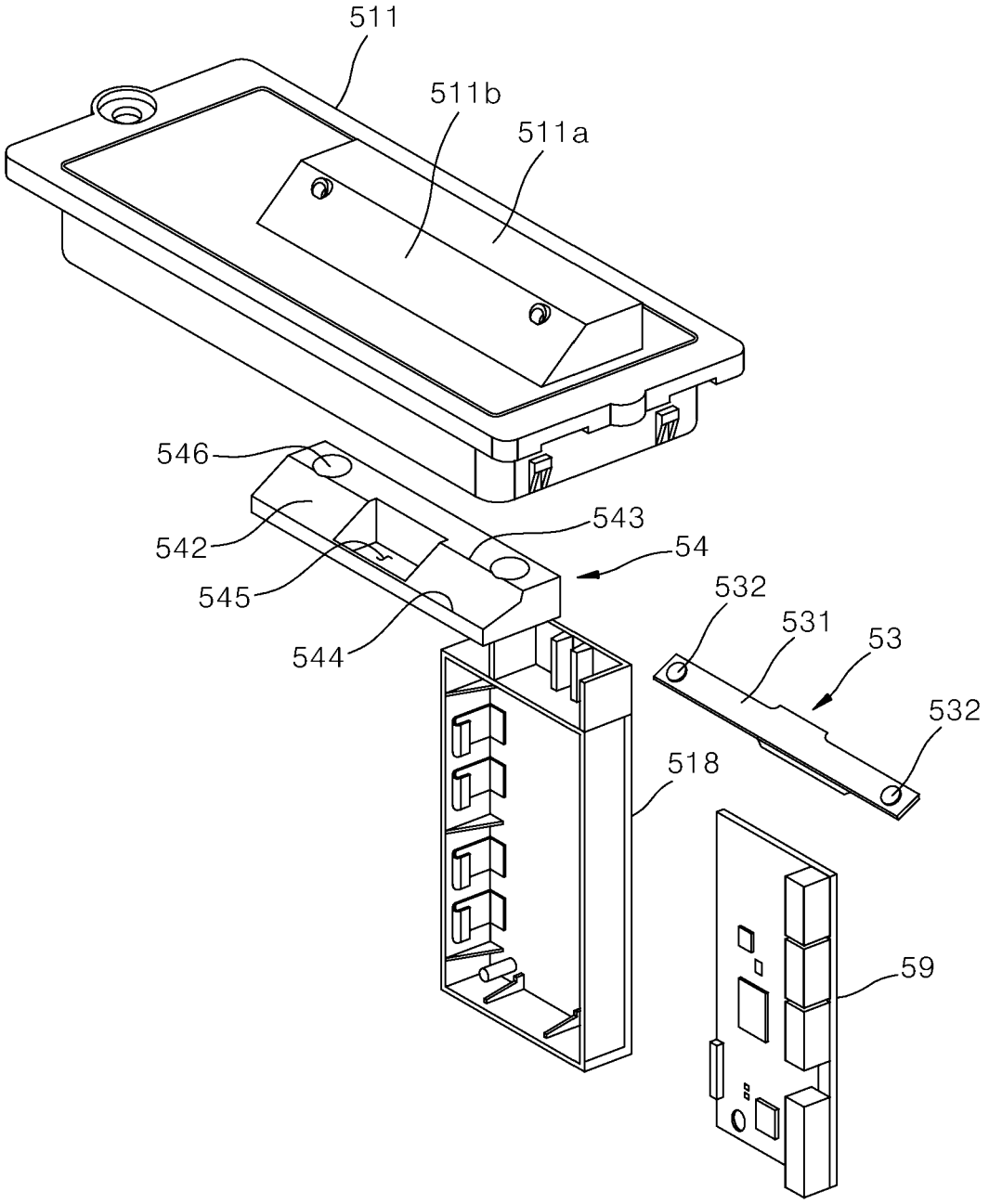
FIG. 5 is an exploded perspective view of the microphone mount of FIG. 3.
Figure 6:
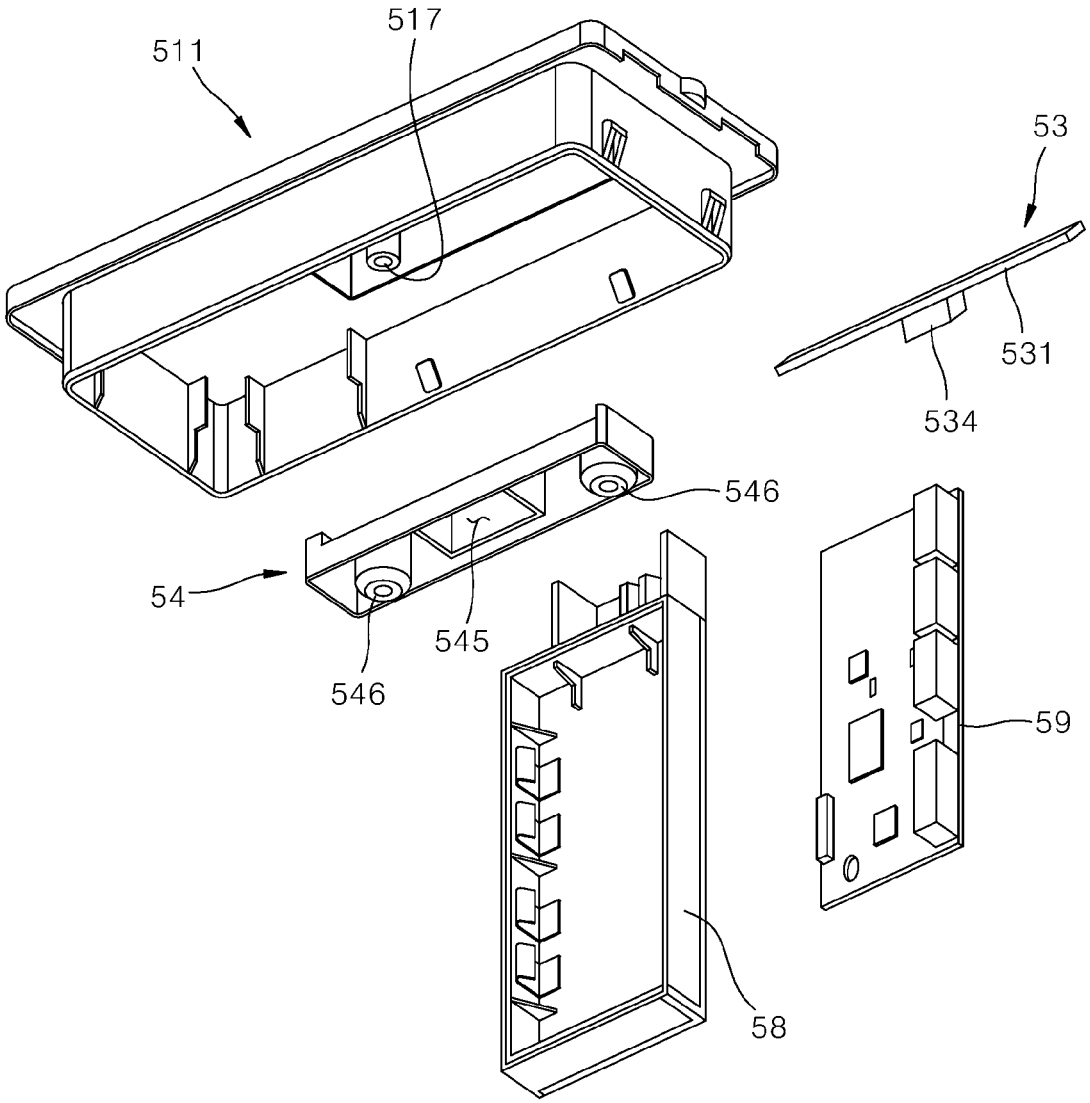
FIG. 6 is an exploded perspective view of the microphone mount of FIG. 4.

In the above-described implementation, a main PCB 11 as a controller may be mounted in the left door 21. However, the main PCB 11 may be installed in the speaker mount 514 or the microphone mount 511. In contrast to FIG. 4, FIG. 7 shows a microphone mount 511 in which the main PCB 11 is further installed.

Hereinafter, the operation of the refrigerator 1 having the above structure will be described. In the refrigerator 1, the components that are operated in the refrigeration cycle including the compressor may be operated under the control of the main PCB 11 to cool the inside of the refrigerator. The main PCB 11 may control an overall operation of the refrigerator and may be referred to as "a main controller" or "a controller".

The user may directly manipulate the first display 24 or the second display 231 of the refrigerator 1 to operate the refrigerator 1. Further, the temperature of the refrigerator 1 may be manipulated, and a specific function execution may be manipulated through the manipulation input of the user. It may also be possible to perform a manipulation such as taking out water or ice through the dispenser 23 or a manipulation of turning on and off the door light to see through the sub-door 40.

On the other hand, it may be possible to control the operation of the refrigerator 1 by recognizing a voice input of the user when the user may not use both hands or the user is away from the refrigerator 1 such that it is difficult for the user to directly operate the refrigerator 1.

For example, when the user speaks a set trigger voice in front of the refrigerator 1, a speech recognition mode may be activated by the microphone module 53 and the substrate 59 so that the user may input the speech command to operate the refrigerator 1. When the user issues a command, the speech signal inputted to the microphone module 53 may be processed by the substrate 59 and then transmitted to the main PCB 11 to control a specific operation of the refrigerator.

An example of a function operated by the speech of the user will be described below. The user may determine the operation state of the refrigerator 1 by turning on and off the displays 24 and 231 of the refrigerator 1 through speech or voice command of the user. Further, the temperature sensed by the temperature sensor in the refrigerator may be outputted to the display 24 and 231, and the user may adjust the temperature of the refrigerating compartment and the freezer compartment through speech with reference to the outputted temperature or may allow the refrigerator to be operated in a desired state.

Then, the user may turn on and off the door light 225 through the speech command of the user. When the door light 225 is turned on and off, the sub-door 40 may be selectively transparent/opaque. The perspective part 421*a* of the sub-door 40 may be visible when the door light 225 is turned on so that the inside of the door basket 221 may be identified even when the sub-door 40 is closed.

The user may manipulate the dispenser 23 by means of the speech command of the user. Water or ice may be taken out by means of the speech command of the user. When the user inputs a desired amount of water through speech, the dispenser valve 231 and the dispenser 23 may perform a set operation by adjusting the dispenser valve 231 so that the set amount of the water is dispensed through the dispenser.

It may also be possible to select a state of ice of the ice maker 25 and take out the ice through the speech of the user. For example, when the user selects the ice state, such as cubic ice or slushed ice, the ice maker 25 or an ice moving apparatus 251 provided in an ice bank that stores the ice may perform the set operation so that the ice in the selected state is dispensed through the dispenser 23.

Various kind of operation information such as changes in an operation state or the set state of the refrigerator 1 may be outputted on the screen, such as on the first display 24 or the second display 231, and the sound may be outputted by the speaker module 55. The speaker module 55 may output not only the operation information but also whether the speech input of the user is correctly performed through sound to notify the user of the information and an accurate speech command is inputted to the refrigerator 1 from the user.

According to the implementation of the present disclosure, the refrigerator 1 may be applied to various types of other structures than the structure in which space is opened and closed by a pair of doors as described in the above-mentioned implementation. For example, the implementation of the present disclosure may also be applied to a structure in which one space is opened and closed by a single door. In the implementation of the present disclosure, the cap deco 50 may also be applied to the right refrigerating compartment door 22 and may be applied to any type of door in which the cap deco 50 may be installed, for example, the door that is opened and closed in a rotational manner and a door that is taken out like a drawer.

According to an implementation of the present disclosure, a microphone and a speaker may be installed in a cap deco 50 installed at an upper portion of a door 20, of a refrigerator 1. The cap deco 50 may be higher than an eye level of the user.

A portion of the door cover 51 that defines an upper surface of the cap deco 50 may include a microphone accommodator 503 in which a microphone is accommodated and a speaker accommodator 504 in which a speaker is accommodated, and the microphone accommodator 503 and the speaker accommodator 504 may be defined as separate spaces from each other. A distance between the microphone element 532 of the microphone and the speech output 550 of the speaker may be 85 mm or more and 200 mm or less.

A microphone mount 511 may be installed in the microphone accommodator 503 and a speaker mount 514 manufactured as a separate component from the microphone mount 511 may be installed in the speaker accommodator 504. The microphone mount 511 may protrude from the surface of the door cover 51 of the cap deco 50.

The microphone mount 511 may include a protrusion 511*a* arranged on the microphone mount 511; an inclination 511*b* that is inclined downward from the front of the protrusion 511*a* and connects the microphone mount 511 and the protrusion 511*a*; a hole guide 512*a* that is provided on the inclination 511*b* and covers above a microphone hole 512; and the microphone hole 512 formed in the inclination 511*b* to connect an inner space of the microphone mount 511 defined by the protrusion 511*a* and the inclination 511*b* and a space in front of the inclination 511*b*. The microphone mount 511 may have the inclination 511*b* so that a shape, in which the protrusion 511*a* is exposed, is not visible to the user.

By covering the microphone hole 512 formed in the inclination 511*b* with the hole guide 512*a*, it may be possible to prevent a foreign substance from being introduced into the microphone hole 512 and guide the speech of the user to an inside of the microphone hole 512. The microphone hole 512 may penetrate upward toward the front so that an inner space of the microphone mount 511 is not exposed when the microphone hole 512 is viewed in a horizontal direction of the microphone hole 512 in front of the microphone hole 512, while enhancing an efficiency of collecting the speech of the user.

A microphone module 53 may be installed in the inner space of the microphone mount 511. The microphone module 53 may include a microphone element 532; a microphone substrate 531 on which the microphone element 532 is mounted; and a microphone connector 534 mounted on a rear surface of the microphone substrate 531.

The microphone module 53 may be fixed to the microphone mount 511 so that the surface of the microphone substrate 53 faces the rear surface of the inclination 511*b*. The microphone module 53 may be installed in the inner space of the microphone mount 511 so that the microphone element 532 faces the microphone hole 512.

A sealing member 533 surrounding the microphone element 532 may be provided at a circumference of the microphone element 532. The sealing member 533 may be interposed between the rear surface of the inclination 511*b* and the surface of the microphone substrate 531. The sealing member may be made of an elastic material and a thickness of the sealing member may be greater than a thickness of the microphone element.

The sealing member 533 may block the noise of the inner space of the microphone mount 511 from being transmitted to the microphone element 532 and may absorb the vibration so that the vibration of the member itself of the microphone mount 511 is not transmitted to the microphone element 532. The microphone module 53 may be fixed to the microphone mount 511 by a microphone supporter 54 that supports the microphone module 53.

A microphone mounting boss 517 protruding downward may be provided on a lower surface of the protrusion 511*a*. The microphone supporter 54 may include a support surface 542 that faces the rear surface of the inclination 511*b* with the microphone module 53 therebetween; a connector hole 545 that is provided on the support surface 542 and exposes the microphone connector 534 of the microphone substrate 531 supported by the support surface 542 downward; a mounting surface 541 that is connected to the support surface 542 and faces the lower surface of the protrusion 511*a*; and a supporter through-hole 546 that is provided on the mounting surface 541 and is engaged upward from the lower portion of the microphone mounting boss 517 toward the microphone mounting boss 517.

The supporter through-hole 546 and the microphone mounting boss 517 may be engaged with each other. A screw (S) may be fastened upward to the microphone mounting boss 517 through the supporter through-hole 546.

The microphone mount 511 may further include a front rib and a rear rib that are formed along a front end and a rear end of the inclined part and contact the front end and the rear end of the microphone module and protrude downward to accommodate the microphone module. The microphone supporter 54 may further include an upper rib and a lower rib that are formed along the front and rear ends of the support surface and contact the outer surfaces of the front rib and the rear rib.

A plurality of microphone holes may be spaced apart from one another by a predetermined distance and the microphone elements corresponding to the number of the microphone holes may be provided in the microphone module. A substrate 59 that is electrically connected to the microphone element 532 installed in the microphone mount 511 and processes a signal of the microphone element 532 may be installed in the microphone mount 511. Therefore, a length of the signal transmission path between the microphone element 532 and the substrate 59 is minimized, so that an occurrence of noise in signal is minimized.

A substrate mount 518 may be detachably mounted on the microphone mount 511 and the substrate 59 may be mounted on the substrate mount 518. Therefore, it may be possible to share components between different products from each other.

The speaker mount 514 may have a depression 5144 depressed from the surface of the speaker mount 514 and a speaker hole 515 opened upward may be formed at the bottom of the depression 5144 so that a passage in which the sound of the speaker is outputted may be provided while a configuration of the speaker is invisible to the user. The speaker module 55 may be installed in the lower portion of the speaker hole 515 when the speech output 550 of the speaker module 55 is aligned to face the speaker hole 515 and to face upward.

A protruding part 515*a* protruding upward may be provided at an edge of the speaker hole 515 and a speaker cover 57 that has a plate 571 that covers the speaker hole 515 vertically may be installed over the depression 5144. An outer edge of the plate 571 and an inner circumferential wall of the depression 5144 may be spaced apart from each other and the lower surface of the plate 571 and the upper end of the protruding part 515*a* may be spaced apart from each other.

Further, the height of the plate 571 and the height of the surface of the speaker mount 514 may match with each other. Thus, it may be possible to enable the configuration of the speaker to be invisible to the user and to prevent the foreign substance from being introduced into the speaker through the speaker hole 515, while providing the passage through which the sound of the speaker is outputted.

A ditch groove 505 may be formed on the outer circumference of the speaker accommodator 504 and a fitting part 5166 that is fit to the ditch groove 505 may be provided at the outer edge of the speaker mount 514. A second drainage groove 5155 may be formed in a side wall of the depression 5144. The second drainage groove 5155 may be arranged in the fitting groove 5057 provided in the inner member 508 of the ditch groove 505.

The first drainage groove 5055 may be formed in an area of the outer member 509 of the ditch groove 505 facing the fitting groove 5057. Further, a threshold 5056 having a height greater than that of the bottom of the ditch groove 505 may be provided at the lower end of the fitting groove 5057.

A substrate 59 that controls the refrigerator may be installed on the speaker mount 514. The substrate mount 518 may be detachably installed on the speaker mount 514 and the substrate 59 may be mounted on the substrate mount 518. Therefore, it may be possible to share components between different products from each other.

According to the implementation of the present disclosure, the refrigerator 1 may further include a controller electrically connected to the microphone and the speaker installed on the cap deco 50. The cap deco 50 and the controller may be installed on the same door 20.

It may be possible to provide a door light that is turned on and off based on a signal inputted to the microphone module. A dispenser may be provided to dispense water or ice based on a signal inputted to the microphone module. Based on the signal inputted to the microphone module, it may be possible to output an operation state and information of the refrigerator to the display.

A door opening apparatus that opens the door by pushing the cabinet may be accommodated in the door and the door opening apparatus may be operated according to a speech command of the user inputted to the microphone module.

In the suggested refrigerator according to implementation of the present disclosure, the following effects may be expected. According to the implementation of the present disclosure, in the refrigerator, the microphone module may be accommodated in the cap deco at the upper end of the door, and the microphone hole may be formed at the upper end of the cap deco to prevent a direct exposure of the microphone hole to the user while improving the speech recognition rate.

In particular, the microphone hole may be formed on the inclined part of the protruding microphone mount, so that the microphone hole may be provided at a minimum protrusion height. Further, the microphone hole formed on the inclined part may be invisible to the user, so that the speech recognition is effectively performed, and the microphone hole may be prevented from being exposed.

Further, a hole guide may be formed at the circumference of the microphone hole, and dust or foreign substances may be prevented from being directly introduced into the microphone hole by the hole guide. Further, slope of an upper end of the microphone hole formed on the inclined part may be stiffer than the inclined part, thereby preventing the dust or the foreign substance from being introduced into and inputting the speech of the user more effectively. The microphone module may be fixed to the inclined part, and may be stably fixed to the door by a microphone supporter.

As the microphone module is mounted on the door cover, the noise or impact of the refrigerator, which may be generated when the refrigerator is operated, may not be directly transmitted to the microphone module, and the microphone module may be suspended from the inner space of the microphone mount, thereby minimizing the transmission of the noise and the vibration, from the cabinet of the refrigerator. Therefore, it may be possible to expect an effect of improving speech recognition performance by reducing the noise.

Further, even though the door is repeatedly opened and closed and the impact is applied to the door, it may be possible to maintain a normal mounting state of the microphone module through a stable support of the microphone supporter.

Further, the microphone module may include a sealing member that seals between the substrate on which the microphone element is mounted and the rear surface of the door cover, thereby preventing the noise from being introduced into the microphone. Further, even if the impact is applied to the door, it may be possible to protect the microphone module by absorbing the impact by the sealing member having elasticity to reduce noise caused by the impact. Therefore, there may be an advantage that the possibility of an incorrect input of the speech may be reduced and the speech recognition performance may be improved.

The microphone mount 511 and the speaker unit 514 may be modularized and installed in the cab deco. Therefore, in a service situation, the microphone module and the speaker module may be detached from or attached to the modularized microphone mount 511 and the speaker mount 514 respectively, thereby enabling easy service and maintenance.

Further, the microphone module and the speaker module may be separately disposed from the substrate 59 and may be mounted on the microphone mount 511 and the speaker mount 514 respectively so that it may be possible to expect an effect that a space for service work may be provided, and the assembling workability of the microphone module and the speaker module may be improved.

A speaker accommodator of the cap deco may be assembled with the speaker mount on which the speaker module is mounted. The speaker hole and the protruding part at the circumference of the speaker hole may be formed in the depressed inner side of the speaker mount to thereby prevent the dust or the foreign substance from passing through the speaker module. A structure of the ditch groove may also be provided in the speaker accommodator to prevent the dust or the foreign substance from passing through the speaker accommodator.

Further, the speaker mount may have a speaker cover to prevent the dust or the foreign substance from being introduced into it and to effectively output the sound of the speaker. Further, the speaker accommodator and the microphone accommodator may be defined as separate spaces from each other, and the speaker mount installed in the speaker accommodator and the microphone mount installed in the microphone accommodator may be manufactured as separate parts from each other, so that transmitting the noise of the speaker to the microphone may be minimized to thereby increase the speech recognition rate.

According to the implementation, the door may be automatically opened by driving the door opening apparatus through the speech or voice input of the user even when the user holds an object with both hands, thereby improving the use convenience. Water or ice may be dispensed through the dispenser by operating the dispenser through the speech input of the user and an amount in which the water or the ice is taken out through the dispenser may also be adjusted such that the water or the ice may be smoothly taken out through the dispenser even when the hands of the user are not free.

Further, an output screen of the display may be adjusted through the speech input of the user. Therefore, even when the user is away from the refrigerator, it may be possible to display and determine the operation state of the refrigerator using the speech of the user and operate and input the specific operation of the refrigerator.

While the present disclosure has been described with reference to exemplary drawings thereof, it is to be understood that the present disclosure is not limited to the implementations and drawings disclosed in the present disclosure, and it will be understood that various modifications may be made by those skilled in the art within the scope of the technical idea of the present disclosure. Although the working effects of the configurations of the present disclosure is not explicitly explained in the description of the implementations of the present disclosure above, an effect predicted by the configuration has to be also recognized.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet having a storage space; and a door configured to open or close the storage space, wherein the door comprises:

a first space of the door defined by an outer plate, a door liner, and a cap deco;

a heat insulating material filled in the first space;

a microphone accommodator provided in the cap deco and having a second space;

a microphone mount shielded in the second space and having a protrusion and an inclination;

a microphone hole formed in the inclination; and a microphone module provided within the second space, and wherein the inclination is formed at a front end of the protrusion and the microphone module is positioned below the inclination.

2. The refrigerator of claim 1, wherein the inclination is inclined downward in a forward direction.

3. The refrigerator of claim 2, wherein the microphone hole is includes a plurality of microphone holes, and wherein the microphone module is positioned such that a microphone of the microphone module faces the microphone hole.

4. The refrigerator of claim 2, further comprising a hole guide that protrudes from the inclination and positioned above the microphone hole.

5. The refrigerator of claim 4, wherein a protruding length of the hole guide decreases in a direction toward a bottom of the inclination.

6. The refrigerator of claim 1, wherein the microphone module comprises:

a microphone; and a microphone substrate on which the microphone is mounted, wherein the microphone is installed in an inner space of the microphone mount such that the microphone faces the microphone hole, and wherein the microphone substrate is installed on the rear of the inclination at an angle.

7. The refrigerator of claim 6, further comprising a seal surrounding the microphone, wherein the seal is provided between the inclination and the microphone substrate and is formed of an elastic material having a hole in the center, and wherein the microphone is positioned inside the hole of the seal.

8. The refrigerator of claim 6, wherein the microphone module further includes a microphone connector provided at a rear of the microphone substrate, wherein the microphone mount further includes a microphone supporter that supports the microphone module, and wherein the microphone supporter comprises:

a support surface that faces the rear surface of the inclination with the microphone module interposed therebetween; and a connector hole provided on the support surface that exposes the microphone connector of the microphone substrate supported by the support surface downward.

9. The refrigerator of claim 8, wherein further comprising a microphone mounting boss that protrudes downward and is provided on a lower surface of the protrusion, wherein the microphone supporter comprises:

a mounting surface that is connected to the support surface and faces the lower surface of the protrusion;

a supporter through-hole provided on the mounting surface and engaged upward from a lower portion of the microphone mounting boss toward the microphone mounting boss; and a screw that is fastened to the microphone mounting boss upward through the supporter through-hole.

10. The refrigerator of claim 1, wherein an interior of the cabinet is partitioned vertically and horizontally, with a refrigerating compartment being formed at a top and a freezer compartment formed at a bottom, wherein the door comprises a refrigerating compartment door that opens and closes the refrigerating compartment, and a freezer compartment door that opens and closes the freezer compartment, wherein the refrigerating compartment door includes a left refrigerating compartment door and a right refrigerating compartment door, and a dispenser being provided on a front of the left refrigerating compartment door, wherein the right refrigerating compartment door includes a main door and a sub-door configured to open and close a central opening of the main door, and wherein the cap deco is installed on a top of the left refrigerating compartment door.

11. A refrigerator comprising:

a cabinet having a storage space; and a door configured to open or close the storage space, wherein the door comprises:

a first space of the door defined by an outer plate, a door liner, and a cap deco;

a heat insulating material filled in the first space;

a speaker accommodator provided in the cap deco and having a second space;

a speaker mount shielding the second space and having a depression;

a speaker hole formed in the depression;

a speaker cover positioned above the speaker hole;

a speaker module disposed within the second space; and a first drainage groove formed in the speaker accommodator and a second drainage groove formed in the speaker mount, the second drainage groove being formed in a side wall of the depression, and the first drainage groove being provided at a position corresponding to the second drainage groove.

12. The refrigerator of claim 11, wherein the speaker module is located beneath the depression, and the speaker module comprises a sound output module configured to face the speaker hole.

13. The refrigerator of claim 11, wherein the speaker mount includes an annular lip protruding from an edge of the speaker hole, wherein the annular lip protrudes both upward and downward, and wherein the speaker cover is positioned above the annular lip, and the speaker module is positioned below the annular lip.

14. The refrigerator of claim 13, wherein:

the speaker cover includes a plate that covers the speaker hole, an outer edge of the plate and an inner circumferential wall of the depression are spaced apart from each other, and a lower surface of the plate and an upper end of the annular lip are spaced apart from each other, and wherein the plate bigger than the speaker hole.

15. The refrigerator of claim 14, further comprising:

a ditch groove provided at an outer edge of the speaker accommodator, and a fitting part configured to be inserted into the ditch groove is provided at an outer edge of the speaker mount.

16. The refrigerator of claim 15, wherein:

the ditch groove is defined between an outer wall and an inner wall;

a fitting groove is provided in the inner wall at a position aligned with the first drainage groove;

the second drainage groove is positioned to communicate with the fitting groove; and a lower end of the fitting groove includes a threshold having a height higher than a bottom of the ditch groove.

17. The refrigerator of claim 11, wherein an interior of the cabinet is partitioned vertically and horizontally, with a refrigerating compartment being formed at a top and a freezer compartment being formed at a bottom, wherein the door comprises a refrigerating compartment door that opens and closes the refrigerating compartment, and a freezer compartment door that opens and closes the freezer compartment, wherein the refrigerating compartment door includes a left refrigerating compartment door and a right refrigerating compartment door, and further comprising a dispenser provided on a front of the left refrigerating compartment door, wherein the right refrigerating compartment door includes a main door and a sub-door configured to open and close a central opening of the main door, and wherein the cap deco is installed on a top of the left refrigerating compartment door.

18. The refrigerator of claim 11, wherein a substrate configured to control the refrigerator is installed in the speaker mount, a substrate mount is detachably installed on the speaker mount, and the substrate is mounted on the substrate mount.

19. The refrigerator of claim 11, further comprising a microphone mount having a protrusion configured to protrude with respect to an upper surface of the cap deco, wherein the cap deco includes a microphone accommodator in which the microphone mount is provided.

20. A refrigerator comprising:

a cabinet having a storage space; and a door configured to open or close the storage space, wherein the door comprises:

a first space of the door defined by an outer plate, a door liner, and a cap deco;

a heat insulating material filled in the first space;

a microphone accommodator provided in the cap deco and having a second space;

a microphone mount shielding in the second space;

a microphone hole formed in the microphone mount;

a microphone module disposed within the second space;

a speaker accommodator provided in the cap deco and having a third space;

a speaker mount shielding in the third space;

a speaker hole formed in the speaker mount; and a speaker module disposed within the third space, and wherein the microphone module is suspended from the microphone mount, and the speaker module is suspended from the speaker mount.

21. The refrigerator of claim 20, further comprising a hole guide protruding from the inclination and positioned above the microphone hole, wherein a protruding length of the hole guide decreases in a direction toward a bottom of the inclination.

22. The refrigerator of claim 20, wherein the microphone module comprises:

a microphone; and a microphone substrate on which the microphone is mounted, wherein the microphone is installed in an inner space of the microphone mount such that the microphone faces the microphone hole, and wherein the microphone substrate is installed on the rear of the inclination at an angle.

23. The refrigerator of claim 22, further comprising a seal surrounding the microphone, wherein the seal is provided between the inclination and the microphone substrate and is formed of an elastic material having a hole in the center, and wherein the microphone is positioned inside the hole of the seal.

24. The refrigerator of claim 22, wherein the microphone module further includes a microphone connector provided at a rear of the microphone substrate, wherein the microphone mount further includes a microphone supporter that supports the microphone module, and wherein the microphone supporter comprises:

a support surface that faces the rear surface of the inclination with the microphone module interposed therebetween; and a connector hole provided on the support surface that exposes the microphone connector of the microphone substrate supported by the support surface downward.

25. The refrigerator of claim 20, further comprising a speaker cover positioned above the speaker hole, wherein the speaker mount includes an annular lip protruding from an edge of the speaker hole, wherein the annular lip protrudes both upward and downward, and wherein the speaker cover is positioned above the annular lip, and the speaker module is positioned below the annular lip.

26. The refrigerator of claim 25, wherein:

the speaker mount has a depression, the speaker cover includes a plate that covers the speaker hole, an outer edge of the plate and an inner circumferential wall of the depression are spaced apart from each other, and a lower surface of the plate and an upper end of the annular lip are spaced apart from each other, wherein the plate bigger than the speaker hole.

27. The refrigerator of claim 26, further comprising a first drainage groove and a second drainage groove formed in the speaker mount, wherein the second drainage groove is formed in a side wall of the depression.

28. The refrigerator of claim 27, further comprising:

a ditch groove provided at an outer edge of the speaker accommodator, and a fitting part configured to be inserted into the ditch groove is provided at an outer edge of the speaker mount.

29. The refrigerator of claim 28, wherein:

the ditch groove is defined between an outer wall and an inner wall;

a fitting groove is provided in the inner wall at a position aligned with the first drainage groove;

the second drainage groove is positioned to communicate with the fitting groove; and a lower end of the fitting groove includes a threshold having a height higher than a bottom of the ditch groove.

30. The refrigerator of claim 20, wherein an interior of the cabinet is partitioned vertically and horizontally, with a refrigerating compartment being formed at a top and a freezer compartment formed at a bottom, and wherein the door comprises a refrigerating compartment door that opens and closes the refrigerating compartment, and a freezer compartment door that opens and closes the freezer compartment, wherein the refrigerating compartment door includes a left refrigerating compartment door and a right refrigerating compartment door, and further comprising a dispenser provided on a front of the left refrigerating compartment door, wherein the right refrigerating compartment door includes a main door and a sub-door configured to open and close a central opening of the main door, and wherein the cap deco is installed on a top of the left refrigerating compartment door.

* * * * *